US007929873B2

(12) United States Patent
Takeuchi et al.

(10) Patent No.: US 7,929,873 B2
(45) Date of Patent: Apr. 19, 2011

(54) IMAGE FORMING APPARATUS AND IMAGE DENSITY CONTROL METHOD

(75) Inventors: Nobutaka Takeuchi, Yokohama (JP); Shin Hasegawa, Zama (JP); Hitoshi Ishibashi, Kamakura (JP); Shuji Hirai, Ohta-ku (JP); Kohta Fujimori, Yokohama (JP); Kayoko Tanaka, Machida (JP); Yushi Hirayama, Sagamihara (JP); Kentaroh Tomita, Sagamihara (JP); Akira Yoshida, Kawasaki (JP); Chiemi Hirano, Hamura (JP)

(73) Assignee: Ricoh Company Limited, Tokyo (JP)

( * ) Notice: Subject to any disclaimer, the term of this patent is extended or adjusted under 35 U.S.C. 154(b) by 344 days.

(21) Appl. No.: 12/037,717

(22) Filed: Feb. 26, 2008

(65) Prior Publication Data

US 2008/0205923 A1 Aug. 28, 2008

(30) Foreign Application Priority Data

Feb. 26, 2007 (JP) ..... 2007-045664

(51) Int. Cl.
*G03G 15/08* (2006.01)

(52) U.S. Cl. ..... 399/30

(58) Field of Classification Search ..... 399/29, 399/30, 44, 55, 59, 61, 62, 94, 97
See application file for complete search history.

(56) References Cited

U.S. PATENT DOCUMENTS

| | | | | |
|---|---|---|---|---|
| 5,327,196 | A | 7/1994 | Kato et al. | |
| 2006/0018674 | A1 * | 1/2006 | Hirata et al. | 399/29 |
| 2006/0269303 | A1 * | 11/2006 | Zollner et al. | 399/30 |
| 2007/0116480 | A1 | 5/2007 | Takeuchi et al. | |
| 2008/0205922 | A1 * | 8/2008 | Tsukada et al. | 399/61 |
| 2009/0016745 | A1 * | 1/2009 | Kolb | 399/27 |
| 2009/0202261 | A1 * | 8/2009 | Tsukada et al. | 399/30 |

FOREIGN PATENT DOCUMENTS

| | | |
|---|---|---|
| JP | 57-136667 | 8/1982 |
| JP | 02-034877 | 2/1990 |
| JP | 09-211911 | 8/1997 |
| JP | 3410198 | 3/2003 |
| JP | 2004-070067 | 3/2004 |
| JP | 2004-151375 | 5/2004 |
| JP | 2005-148368 | 6/2005 |
| JP | 2005-156791 | 6/2005 |
| JP | 2005-274738 | 10/2005 |
| JP | 3871173 | 10/2006 |
| JP | 2007-133235 | 5/2007 |

* cited by examiner

*Primary Examiner* — David P Porta
*Assistant Examiner* — David S Baker
(74) *Attorney, Agent, or Firm* — Oblon, Spivak, McClelland, Maier & Neustadt, L.L.P.

(57) ABSTRACT

An image forming apparatus includes an image carrier configured to carry an electrostatic latent image, a developing device configured to develop the electrostatic latent image with a two-component developer including toner and magnetic carrier, a toner supplier configured to supply the toner to the developing device, a toner concentration detector configured to detect toner concentration in the two-component developer inside the developing device, and a controller. The controller is configured to detect first information to determine toner replacement amount in the developing device during a predetermined time period and second information to determine a charge characteristic of the toner in the developing device, change a toner concentration control reference value based on the first information and the second information, and control the toner concentration based on an output from the toner concentration detector and the toner concentration control reference value.

15 Claims, 12 Drawing Sheets

IMAGE FORMING APPARATUS AND IMAGE DENSITY CONTROL METHOD

CROSS-REFERENCE TO RELATED APPLICATIONS

This patent specification claims priority from Japanese Patent Application No. 2007-045664, filed on Feb. 26, 2007 in the Japan Patent Office, the entire contents of which are hereby incorporated by reference herein.

BACKGROUND OF THE INVENTION

1. Field of the Invention

The present invention generally relates to an image forming apparatus such as a copier, a printer, a facsimile machine, and a multifunction machine including at least two of these functions, and an image density control method performed by the image forming apparatus, and more particularly, to an image forming apparatus and an image density control method using a two-component developer.

2. Discussion of the Background Art

In general, an electrophotographic image forming apparatus such as a copier, a printer, a facsimile machine, etc., forms an electrostatic latent image on an image carrier, develops the electrostatic latent image with a toner, and then transfers the toner image onto a sheet of recording medium.

As methods of developing electrostatic latent images, methods using two-component developer including toner and magnetic carrier are widely known. In such two-component developing methods, the two-component developer, which is hereinafter simply referred to as a developer, is deposited on the image carrier by magnetism of magnetic poles provided inside the image carrier so as to form a magnetic brush thereon. The magnetic brush is rubbed on the electrostatic latent image to develop the electrostatic latent image. At present, such a two-component developing method is widely used because it facilitates color image forming.

However, in such two-component developing methods, if a toner concentration, indicated by a ratio such as weight ratio of toner to carrier in the developer, is excessively high, toner might scatter on a background of an output image or detail resolution capability might be degraded. By contrast, when the toner concentration is excessively low, an image density of a solid image portion might decrease or magnetic carrier might be deposited on the image carrier. Therefore, it is important to keep toner concentration in the developer within a preferable range, for example, by controlling toner supply based on detection result of the toner concentration in the developing device.

However, even if the toner concentration is kept constant, image density can fluctuate during continuous printing depending on the image area ratios of output sheets. For example, when an image of higher image area ratio is output, toner consumption is greater and more toner is newly supplied to the developing device compared to a case in which the image area ratio of an output sheet is lower. Hereinafter, toner replacement amount refers to a ratio of newly supplied toner to existing toner in the developing device. Newly supplied toner is not sufficiently charged, and therefore it is difficult to raise an average toner charge to a preferable level before a subsequent image formation when the toner replacement amount is larger, resulting in a rise in image density. By contrast, when an image of lower image area ratio is output, toner consumption is smaller and less toner is supplied. That is, the amount of toner that remains in the developing device for a relatively long time period is larger compared to a case in which the image area ratio of an output sheet is higher. The longer toner remains in the developing device, the more that toner is agitated and excessively charged, causing an increase in the average charge and a decrease in image density.

In a prior application, an image forming apparatus that includes an information detection means for detecting information to determine the toner replacement amount, and a correction means has been proposed. The toner replacement amount can be determined, for example, by the image area ratio of the output sheets. By using the toner replacement amount determined based on the detection result of the information detection means, the average toner charge for a subsequent image formation in continuous image forming is detected, and then the correction means corrects a reference value for controlling the toner concentration. Thus, image density is kept at a constant density by controlling the toner concentration in the developing device.

However, charge characteristics of the toner tend to change over time and/or with changes in environmental conditions, making consistent toner concentration control difficult.

SUMMARY OF THE INVENTION

In view of the foregoing, various illustrative embodiment of the present invention disclosed herein provide an image forming apparatus and an image density control method that can maintain a constant image density.

In one illustrative embodiment of the present invention, an image forming apparatus includes an image carrier configured to carry an electrostatic latent image, a developing device configured to develop the electrostatic latent image with a two-component developer including toner and magnetic carrier, a toner supplier configured to supply the toner to the developing device, a toner concentration detector configured to detect toner concentration in the two-component developer inside the developing device, and a controller. The controller is configured to detect first information to determine toner replacement amount in the developing device during a predetermined time period and second information to determine a charge characteristic of the toner in the developing device, change a toner concentration control reference value based on the first information and the second information, and control the toner concentration based on an output from the toner concentration detector and the toner concentration control reference value.

In another illustrative embodiment of the present invention, an image forming apparatus includes an image carrier configured to carry an electrostatic latent image, a developing device configured to develop the electrostatic latent image with a two-component developer including toner and magnetic carrier, a toner supplier configured to supply the toner to the developing device, a toner concentration detector configured to detect toner concentration in the two-component developer in the developing device, and a controller. The controller is configured to detect first information to determine toner replacement amount in the developing device during a predetermined time period, change a toner concentration control reference value based on at least the first information, and control the toner concentration based on the toner concentration control reference value and an output from the toner concentration detector. The controller changes the toner concentration control reference value in a direction to increase the toner concentration at a lower change speed than a change speed to change the toner concentration control reference value in a direction to decrease the toner concentration.

In another illustrative embodiment of the present invention, an image density control method includes detecting first information to determine toner replacement amount in the developing device during a predetermined time period and second information to determine a charge characteristic of the toner in the developing device, changing a toner concentration control reference value based on the first information and the second information, and controlling the toner concentration based on an output from the toner concentration detector and the toner concentration control reference value.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
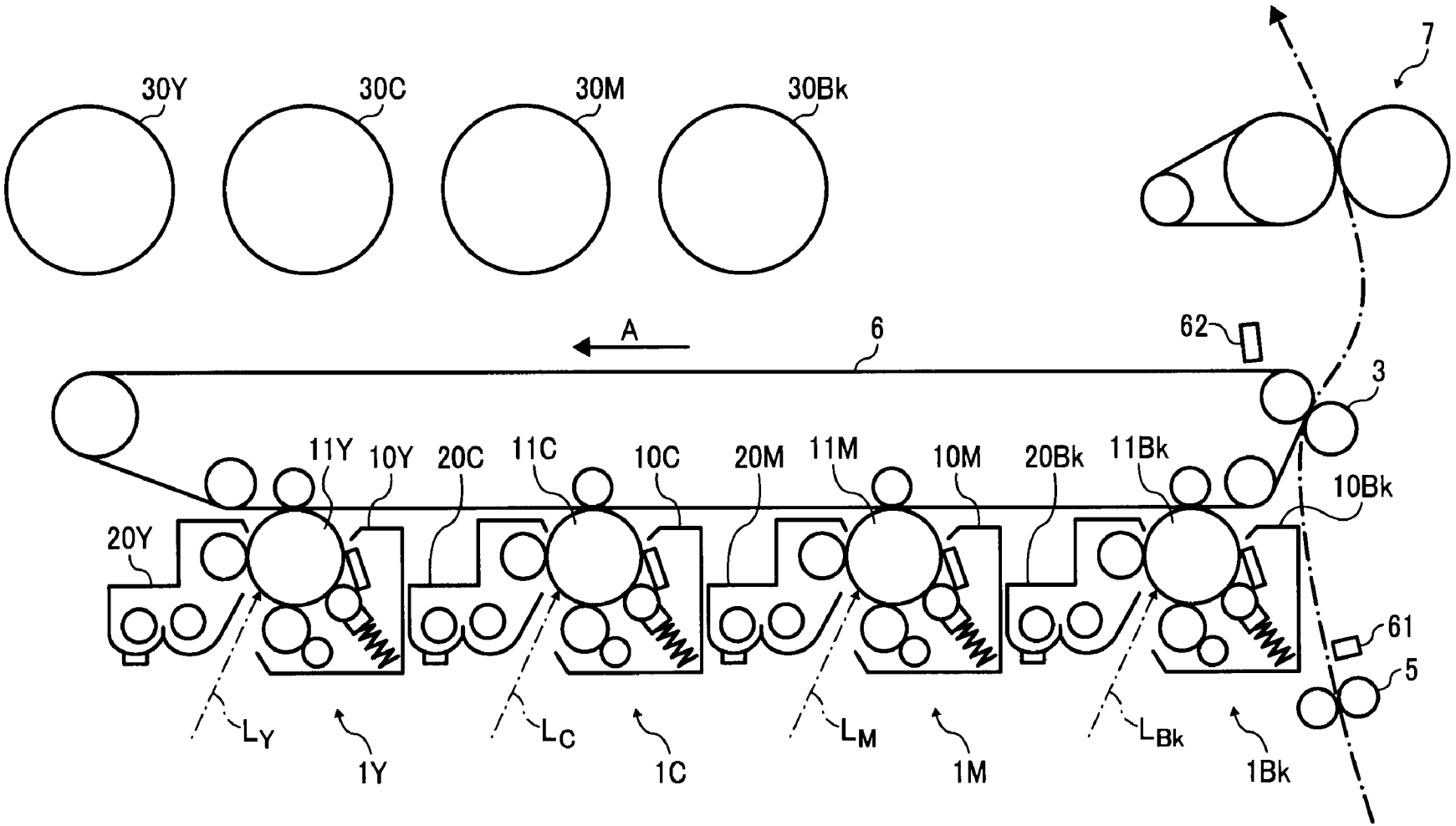
FIG. 1 schematically illustrates a configuration of a main part of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a color laser image forming apparatus according to an illustrative embodiment of the present invention is described.

FIG. 1 is a schematic illustration of a main part of the image forming apparatus. Referring to FIG. 1, the image forming apparatus includes four image forming units 1Y, 1C, 1M, and 1Bk for forming magenta, cyan, yellow, and black toner images, respectively, located sequentially from upstream of a moving direction of an intermediate transfer belt 6 (belt moving direction) shown by arrow A. It is to be noted that the letters Y, C, M, and Bk included in reference characters indicate magenta, cyan, yellow, and black, respectively. The image forming units 1Y, 1C, 1M, and 1Bk include photoreceptor units 10Y, 10C, 10M and 10Bk, and developing devices 20Y, 20C, 20M, and 20Bk, respectively. The photoreceptor units 10Y, 10C, 10M and 10Bk include photoreceptors 11Y, 11C, 11M, and 11Bk as image carriers, respectively. The image forming units 1Y, 1C, 1M, and 1Bk are located so that rotary shafts of the photoreceptors 11Y, 11C, 11M, and 11Bk are located in parallel to each other at regular intervals along the belt moving direction shown by arrow A.

The image forming apparatus further includes a secondary transfer roller 3, a pair of registration rollers 5, a fixer 7, toner cartridges 30Y, 30C, 30M, and 30Bk containing toner, a temperature and humidity sensor 61, and reflection density sensor 62 for detecting an image density on the intermediate transfer belt 6. The temperature and humidity sensor 61 is located upstream of the secondary transfer roller 3 in a sheet transport path and detect temperature and humidity inside the image forming apparatus as an environmental detector.

The image forming units 1Y, 1C, 1M, and 1Bk form toner images on the photoreceptors 11Y, 11C, 11M, and 11Bk, and the toner images are transferred and superimposed one on another into a color image on the intermediate transfer belt 6 in a primary transfer process. As the intermediate transfer belt 6 rotary moves, the superimposed color image is transported to a secondary transfer part that is located between the secondary transfer roller 3 and the intermediate transfer belt 6.

The image forming apparatus further includes an optical writing unit, not shown, that directs laser lights $L_Y$, $L_C$, $L_M$, and $L_{Bk}$ onto surfaces of the photoreceptors 11Y, 11C, 11M, and 11Bk and is located beneath the image forming units 1Y, 1C, 1M, and 1Bk. Beneath the optical writing unit, a sheet cassette containing transfer sheets is provided. The transfer sheet is fed from the sheet cassette and transported along the sheet transport path shown by a dashed line in FIG. 1 to a temporary stop position where the registration rollers 5 are located. The registration rollers 5 forward the transfer sheet to the secondary transfer part such a timely manner that the transfer sheet laps over the color image on the intermediate transfer belt 6. After the secondary transfer roller 3 transfers the color image onto the transfer sheet, the fixer 7 fixes the toner image thereon, and then the transfer sheet is discharged onto a discharge tray, not shown.

Figure 2:
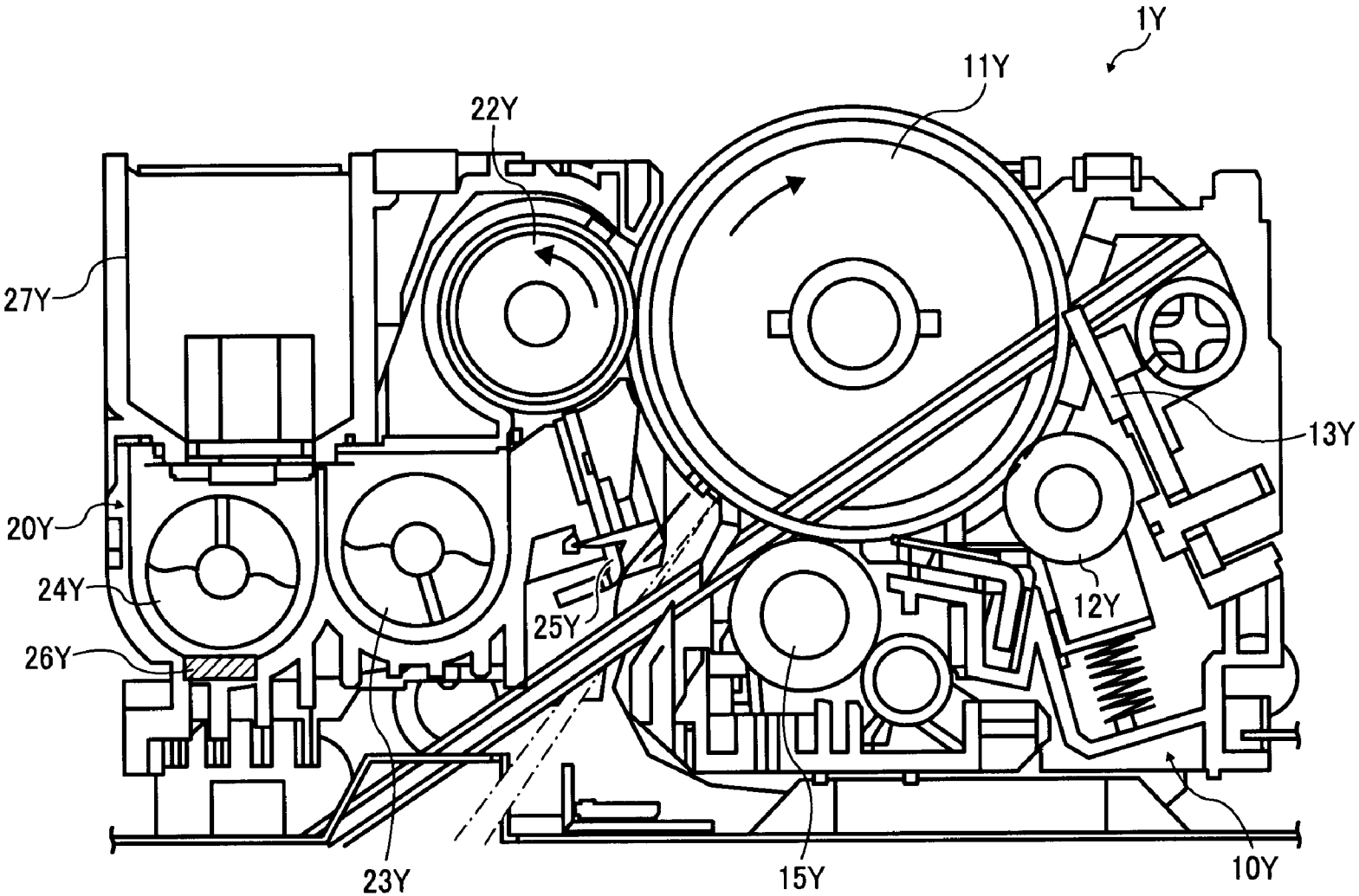
FIG. 2 is an enlarged illustration of an image forming unit for forming yellow images, included in the image forming apparatus illustrated in FIG. 1.

FIG. 2 is an enlarged schematic illustration of the image forming unit 1Y. The image forming unit 1Y is further described below with reference to FIG. 2. The image forming units 1C, 1M, and 1Bk have a configuration similar to the image forming unit 1Y, and thus descriptions thereof omitted.

In FIG. 2, the image forming unit 1Y includes the photoreceptor unit 10Y and the developing device 20Y as described above. The photoreceptor unit 10Y includes a brush roller 12Y, a cleaning blade 13Y as a photoreceptor cleaner, and a charging roller 15, in addition to the photoreceptor 11Y. The brush roller 12 applies lubricant onto the surface of the photoreceptor 11Y and removes electricity therefrom. The brush roller 12Y includes a brush part formed with conductive fibers and a metal core connected to a power source, not shown, for applying a discharge bias.

In the photoreceptor unit 10Y configured as described above, the charging roller 15Y to which voltage is applied charges the surface of the photoreceptor 11Y uniformly. While scanning the charged surface of the photoreceptor 11Y, the optical writing unit, not shown, directs the laser light $L_Y$, which is modulated and deflected, thereonto, thus forming an electrostatic latent image thereon. The developing device 20Y develops the electrostatic latent image into a yellow toner image. The toner image is transferred onto the intermediate transfer belt 6 illustrated in FIG. 1 in a primary transfer part where the photoreceptor 11Y and the intermediate transfer belt 6 face each other. After the toner image is transferred from the photoreceptor 11Y, the surface of the photoreceptor 11Y is cleaned by the cleaning blade 13Y, and then the brush roller 12Y applies a predetermined or desirable amount of lubricant thereto and removes electricity therefrom as preparation for subsequent image forming.

The developing device 20Y develops the electrostatic latent image with a two-component developer including a negatively charged toner and a magnetic carrier, which is hereinafter simply referred to as a developer. Further, the developing device 20Y includes a developing sleeve 22Y as a developer carrier including a nonmagnetic material, and a magnetic roller, not shown, that is a magnetic field generator fixed inside the developing sleeve 22Y. The developing sleeve 22Y is located so as to be partly exposed from an opening of a developing case of the developing device 20Y, provided at a side of the photoreceptor 11Y.

The developing device 20Y further includes first and second screws 23Y and 24Y as agitating transport members, developing doctor 25Y, a magnetic permeability sensor 26Y as a toner concentration detector, a powder pump 27Y as a toner supplier. The image forming unit 1Y further includes a developing bias power source, not shown, as a developing electrical field generator that applies a developing bias to the developing sleeve 22Y. The developing bias includes a negative direct current voltage (DC component) onto which an alternating current voltage (AC component) is superimposed. Thus, the developing sleeve 22 is biased to a predetermined or desirable voltage with respect to a metal base layer of the photoreceptor 11Y.

It is to be noted that, alternatively, only a negative DC voltage (DC component) is applied to the developing sleeve 22Y as the developing bias.

In FIG. 2, the first screw 23Y is located in a first agitating transport path, and the second screw 24Y is located in a second agitating transport path. The developer contained in the developing case is agitated and transported by the first and second screws 23Y and 24Y, and thus the toner is frictionally charged. More particularly, some of the developer in the first agitating transport path deposits on a surface of the developing sleeve 22Y. After the thickness of the developer is regulated by the developing doctor 25Y, the developer on the developing sleeve 22Y is transported to a developing area that faces the photoreceptor 11Y. In the developing area, the toner included in the developer on the developing sleeve 22Y adheres on the electrostatic latent image on the photoreceptor 11Y due to effect of the developing electrical field, thus forming a toner image. After passing through the developing area, the developer leaves the developing sleeve 22Y at a developer release position where a polarity to release the developer is located and returns to the first agitating transport path. The developer is transported downstream in the first agitating transport path and further transported from a downstream end of the first agitating transport path to an upstream end of the second agitating transport path. In the second agitating transport path, toner is newly supplied from the powder pump 27. Then, the developer is transported through the second agitating transport path to a downstream end thereof, and further transported to an upstream end of the first agitating transport path. The magnetic permeability sensor 26Y is provided in the developing case, at a position that corresponds to a bottom part of the second agitating transport path.

Because the toner concentration in the developer in the developing case decreases as the toner is consumed in image forming, the toner is supplied by the powder pump 27Y from the toner cartridge 30Y illustrated in FIG. 1. The toner concentration is regulated within a desirable range by supplying the toner according to an output value Vt from the magnetic permeability sensor 26Y. More particularly, the toner supply is controlled based on a difference Tn obtained by deducting the output value Vt of the magnetic permeability sensor 26Y from a target output value $Vt_{ref}$ ($Vt_{ref}$ minus Vt). The target output value $Vt_{ref}$ is a reference value for controlling the toner concentration (toner concentration control reference value). When the difference Tn is a positive number, the toner concentration is determined as sufficient and the powder pump 27Y does not supply the toner. By contrast, when the different Tn is a negative number, the toner concentration is determined as insufficient and the powder pump 27Y supplies the toner. The larger the absolute value of the difference Tn, the larger amount of toner the powder pump 27Y supplies so that the output value Vt approaches the target output value $Vt_{ref}$.

Further, when the number of sheets on which images are formed reaches a given number, a process control operation including adjustment of the target output value $Vt_{ref}$, charge potential, light intensity, etc., is performed. For example, the reference number of sheets may be between 10 and 50. The reference number of sheets is determined about between 5 and 200 according to image forming speed, etc., but not limited thereto. More particularly, for example, a plurality of halftone patterns and filled-in patterns are formed on the photoreceptor 11Y and transferred onto the intermediate transfer belt 6. The image density of the halftone patterns and the filled-in patterns are detected by the reflection density sensor 62 to determine a toner adhesion amount. The target output value $Vt_{ref}$, charge potential, light intensity, etc., are adjusted so as to set the toner adhesion amount to a target amount.

Further, in the present embodiment, the target output value $Vt_{ref}$ is adjusted for each image formation, in addition to the process control operation. Target output value adjustment will be described further in details below together with toner concentration control.

In the four photoreceptors 11Y, 11C, 11M, and 11Bk, only the photoreceptor 11Bk for black, which is located most downstream, is constantly in contact with the intermediate transfer belt 6, forming a permanent transfer nip with the intermediate transfer belt 6. To form a color image on a transfer sheet, all the four photoreceptors 11Y, 11C, 11M, and 11Bk contact the intermediate transfer belt 6. By contrast, to form a black image on a transfer sheet, only the photoreceptor 11Bk is in contact with the intermediate transfer belt 6, and the photoreceptors 11Y, 11C, and 11M are disengaged from the intermediate transfer belt 6.

A controller for controlling the toner concentration is described below with reference to FIG. 3.

Figure 3:
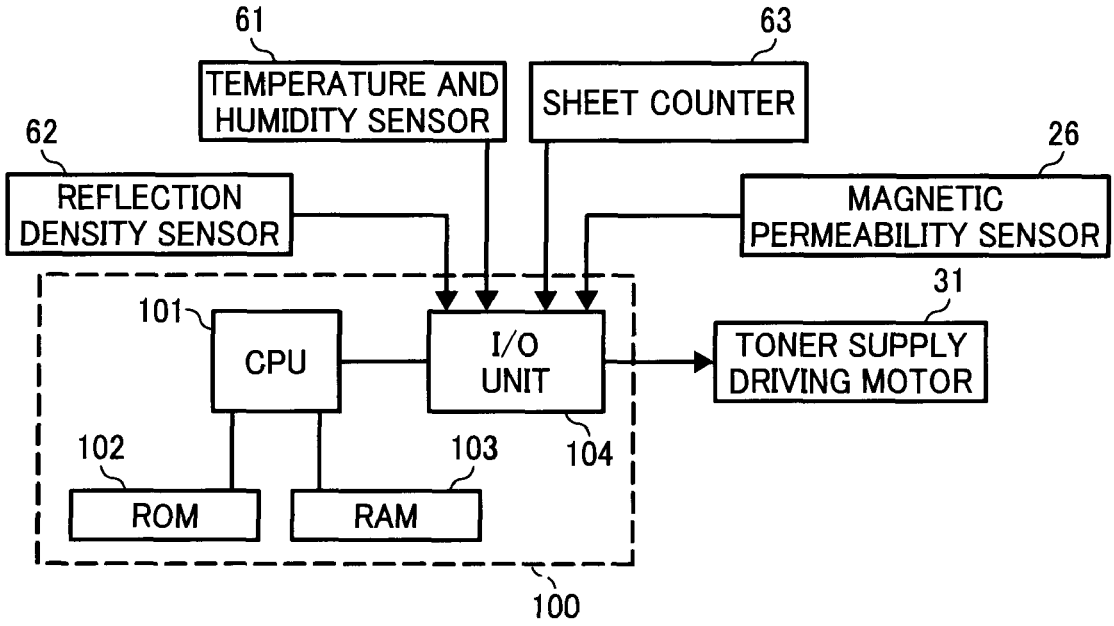
FIG. 3 is a control block diagram of a controller to control toner concentration.

FIG. 3 illustrates a configuration of a controller 100 included in the image forming apparatus illustrated in FIG. 1. The controller 100 is provided for each of the developing device 20Y, 20C, 20M, and 20Bk. Because the controllers 100 have a similar configuration, the reference characters Y, C, M, and Bk for color identification are hereinafter omitted.

As illustrated in FIG. 3, each controller 100 includes a CPU (central processing unit) 101, a ROM (read only memory) 102, a RAM (random access memory) 103, and an I/O (input and output) unit 104. It is to be noted that the four controllers 100 may share some of the components thereof. In the present embodiment, the controllers 100 share the CPU 101, the ROM 102, and the RAM 103.

To the I/O unit 104, the magnetic permeability sensor 26 and the reflection density sensor 62 are connected via an analog-to-digital (A/D) converter, not shown. The controller 100 communicates with a toner supply driving motor 31 that drives the powder pump 27, the temperature and humidity sensor 61, and a sheet counter 63 configured to count the number of output sheets. Based on the number of output sheets, changes in characteristics of the toner over time can be determined.

The controller 100 transmits a control signal to the toner supply driving motor 31 so as to control toner supply according to a predetermined or desirable toner concentration control program that is executed by the CPU 101. Further, by executing a predetermined or desirable target value adjustment program, the target output value $Vt_{ref}$ is adjusted for each image formation so as to maintain a constant image density. The toner concentration control program and the target value adjustment program executed by the CPU 101 are stored in the ROM 102. The RAM 103 includes a Vt register, a $Vt_{ref}$ register, and a Vs register. The Vt register temporarily stores the output value Vt received from the magnetic permeability sensor 26 via the I/O unit 104. The $Vt_{ref}$ register stores the target output value $Vt_{ref}$ that is a reference value to be output by the magnetic permeability sensor 26 when toner concentration in the developer in the developing device 20 is similar or identical to the target toner concentration. The Vs register stores an output value Vs from the magnetic permeability sensor 62. It is to be noted that the controller 100 also functions as a target value changer that is also referred to as a toner concentration control reference value changer.

Figure 4:
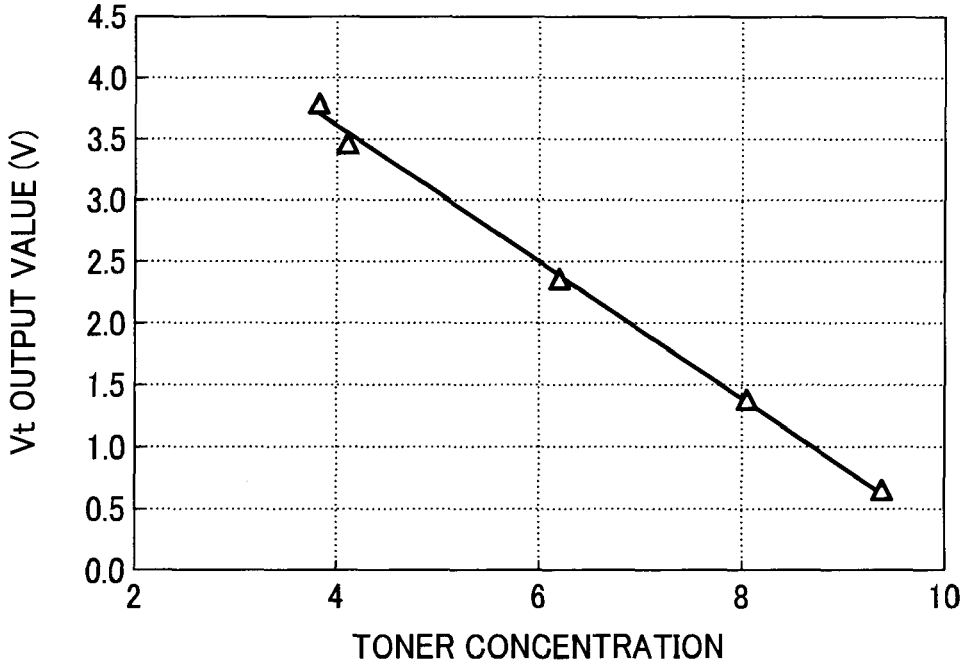
FIG. 4 is a graph illustrating a relation between output values of a magnetic permeability sensor and a toner concentration in a developer in a developing device.

FIG. 4 is a graph illustrating a relation between the output value Vt from the magnetic permeability sensor 26 and the toner concentration in the developer. In FIG. 4, a vertical axis shows the output value Vt from the magnetic permeability sensor 26 and a horizontal axis shows the toner concentration in the developer.

As illustrated in FIG. 4, collinear approximation is observed in the relation between the output value Vt and the toner concentration in the developer within a practical usage range. The relation has a characteristic that the output value Vt from the magnetic permeability sensor 26 decreases as the toner concentration in the developer increases. Based on this characteristic, the powder pump 27 is driven to supply toner when the output value Vt from the magnetic permeability sensor 26 is larger than the target output value $Vt_{ref}$. By contrast, the powder pump 27 is stopped to discontinue toner supply when the output value Vt is smaller than the target output value $Vt_{ref}$. In the present embodiment, toner supply is controlled for each image formation based on the output value Vt from the magnetic permeability sensor 26.

Described below are an image area ratio, which is information to evaluate a toner replacement amount, and a process to change the target output value $Vt_{ref}$, which is the toner concentration control reference value, based on the image area ratio.

Figure 5:
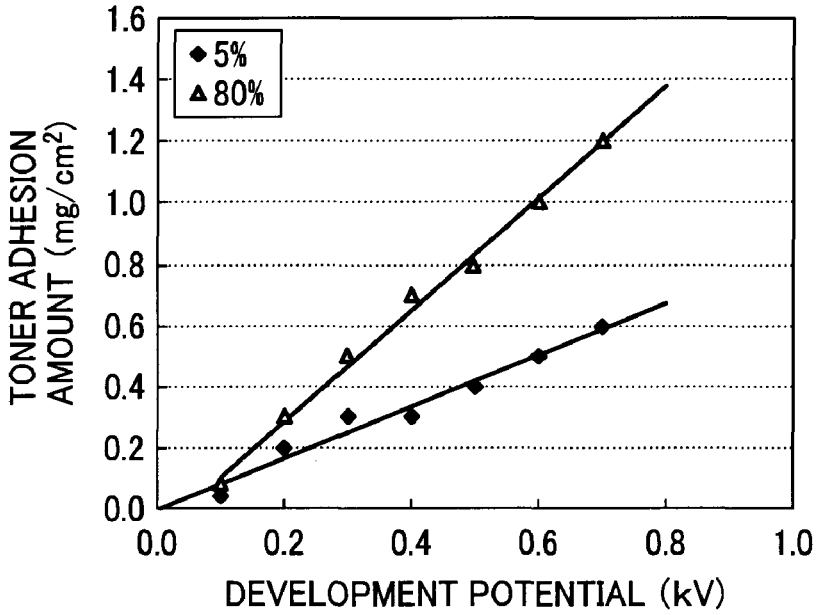
FIG. 5 is a graph illustrating differences in developing gamma depending on an image area ratio.

FIG. 5 illustrates differences in development gamma (γ) that is inclination of a relational expression of the toner adhesion amount with regard to developing potential according to the image area ratio of an output sheet. To create the graph illustrated in FIG. 5, images having an identical image area ratio were continuously formed on 100 sheets at a standard linear speed of 138 millimeters per second (mm/s). As illustrated in FIG. 5, the development γ is higher when the image area ratio of output sheets is higher, because when an image having a higher image area ratio is output, the toner replacement amount in the developing device 20 during a predetermined or given time period is larger and less toner is present in the developing device 20 for a relatively long time period. That is, there is less excessively charged toner in the developing device 20. By contrast, when the image area ratio of the output sheet is lower, a larger amount of toner is present in the developing device 20 for a relatively long time period and there are more excessively charged toner in the developing device 20. Therefore, developability is higher in a case in which the image area ratio is higher than a case in which the image area ratio is lower.

As described above, developability fluctuates due to differences in the toner replacement amount in the developing device 20 for a given time period. Fluctuation in developability affects image density, and thus it becomes difficult to maintain a constant image density in the output sheets. Therefore, the target output value $Vt_{ref}$ is changed so as to maintain constant developability, that is, to keep the development γ constant in principle even if the toner replacement amount in the developing device 20 for a given time period varies. By changing the target output value $Vt_{ref}$, the toner concentration is adjusted so that the output value Vt of the magnetic permeability sensor 26 approaches the changed target output value $Vt_{ref}$. Thus, developability can be kept constant by reducing the toner concentration when the toner replacement amount in the developing device 20 is higher, for example, the image area ratio of an output sheet is higher, and increasing the toner concentration when the toner replacement amount in the developing device 20 is lower, for example, the image area ratio of an output sheet is lower.

It is to be noted that the toner replacement amount in the developing device 20 for a given time period can be evaluated based on area of an output image in square centimeters, image area ratio expressed as a percentage, etc. In the present embodiment, the toner replacement amount is evaluated based on the image area ratio as an example. The image area ratio in percentage is converted into a toner replacement amount in milligrams per page. In the present embodiment, when a filled-in image having an image area ratio of 100% is formed on an A4 size transfer sheet with appropriate developability, 300 mg of toner is consumed and 300 mg of toner is supplied. That is, the toner replacement amount is 300 mg/page. However, in converting the image area ratio into a toner replacement amount, all output transfer sheets should be converted into a standard sheet size, for example, A4 size. In the present embodiment, toner capacity of the developing device 20 is 240 g.

Figure 6:
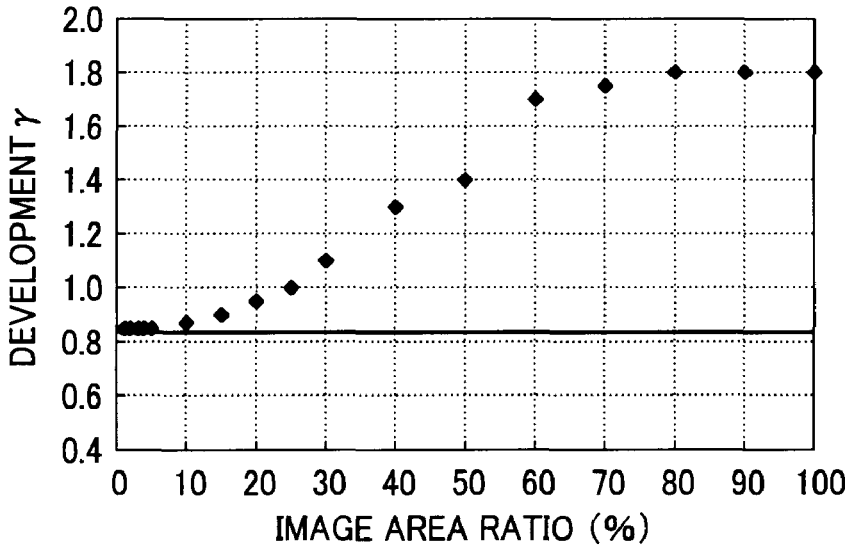
FIG. 6 is a graph illustrating a relation between the image area ratio and the developing gamma.

FIG. 6 is a graph illustrating a relation between image area ratio and development γ, in which a horizontal axis shows image area ratio (%) and a vertical axis shows development γ ($mg/cm^2/kV$). In FIG. 6, a horizontal line indicates a development γ of 0.85.

To create the graph illustrated in FIG. 6, 100 sheets were continuously output for each image area ratio with the toner concentration kept constant, at the same standard linear speed of 138 mm/s used to create the graph illustrated in FIG. 5. As illustrated in FIG. 6, development γ tends to increase when the image area ratio is over a standard value of 5%. Therefore, to maintain a constant image density in the present embodiment, it is preferable to increase the target output value $Vt_{ref}$ so as to lower the toner concentration and development γ when the image area ratio is over 5%. By contrast, the target output value $Vt_{ref}$ is decreased so as to increase the toner concentration when an image having an image area ratio of 5% or less is output after the target output value $Vt_{ref}$ is increased.

Figure 7:
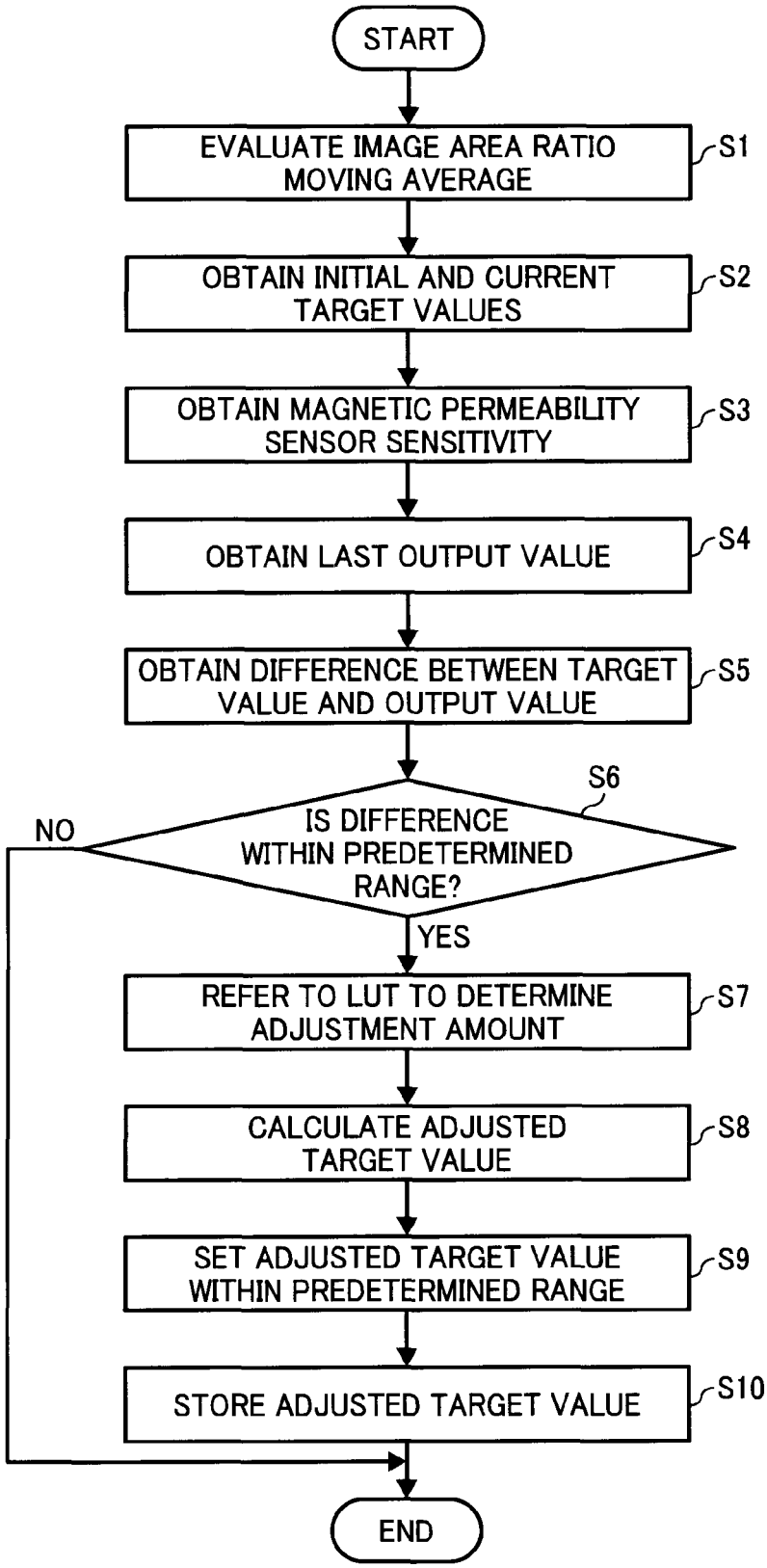
FIG. 7 illustrates a sequence of processes performed in target output value adjustment.

FIG. 7 is a sequence of processes performed in target value adjustment performed by the controller 100 illustrated in FIG. 3 as the target value changer (toner concentration control reference value changer).

This target value adjustment is performed each time after one print job is completed. At S1, the controller 100 evaluates an image area ratio moving average (%) of several sheets or several tens of sheets output most recently in the previous job. Alternatively, a mean value of the image area ratio may be evaluated, instead of the moving average thereof. In the present embodiment, the image area ratio moving average is used as first information to determine the toner replacement amount because a history of toner replacement amounts for the previous output sheets, which is suitable to understand current characteristics of the developer, can be determined based on its moving average. The image area ratio moving average is calculated using formula 1 shown below to simplify calculation thereof.

$$M(i)=(1/N)[M(i-1)\times(N-1)+X(i)] \quad \text{FORMULA 1}$$

wherein M(i) is a current moving average, N is the number of image area ratio samples (cumulative number of sheets), M(i−1) is a moving average that is previously calculated, and X(i) is a current image area ratio. It is to be noted that the current moving average M(i) and the current image area ratio X(i) are calculated separately for each color.

In the present embodiment, because the current moving average M(i) is calculated based on the previous moving average M(I−1), it is unnecessary to store data of image area ratios of several sheets or several tens of sheets that are output most recently in the RAM 103 illustrated in FIG. 3, saving storage area usage of the RAM 103 significantly. Further, control response can be adjusted by changing the cumulative number of sheets N as required. For example, the target output value $Vt_{ref}$ can be effectively adjusted by changing the cumulative number of sheets N according to changes in usage condition and/or over time.

After the current moving average M(i) is calculated as described above, at S2 the controller 100 obtains an initial target output value $Vt_{ref}$1 and a current target output value $Vt_{ref}$2 of the magnetic permeability sensor 26 from the $Vt_{ref}$ register of the RAM 103. The initial target output value $Vt_{ref}$1 and the current target output value $Vt_{ref}$2 are determined by using formula 2 shown below.

$$Vtc=Vti+\Delta Vt_{ref} \quad \text{FORMULA 2}$$

wherein $\Delta Vt_{ref}$ is an amount by which the target output value $Vt_{ref}$ is adjusted (target value adjustment amount).

Further, at S3 the controller 100 obtains sensitivity SV of the magnetic permeability sensor 26. Sensitivity is a value specific to each sensor and expressed in volts per weight percent (V/wt%). The sensitivity SV of the magnetic permeability sensor 26 is the absolute value of the inclination of the line plotted in the graph illustrated in FIG. 5. At S4, the controller 100 obtains the last output value Vt of the magnetic permeability sensor 26, and then calculates a difference D1 between the current target output value $Vt_{ref}$2 obtained at S2 and the last output value Vt at S5 (Vt-$Vt_{ref}$2).

The controller 100 determines whether or not to change the target output value $Vt_{ref}$ based on certain predetermined criteria, such as whether or not a previous process control operation is successful and the difference D1 (Vt-$Vt_{ref}$2) is within a predetermined or desirable range. In the present embodiment, the controller 100 determines whether or not the difference D1 calculated at S5 is within a predetermined or desirable range at S6.

When the difference D1 is within a predetermined or desirable range, at S7 the controller 100 determines the adjustment amount $\Delta Vt_{ref}$ of the target output value $Vt_{ref}$ with reference to a look-up table (LUT) in which toner concentration amounts ΔTC are correlated with image area ratio moving averages. More particularly, referring to the look-up table, the controller 100 determines a toner concentration adjustment amount ΔTC corresponding to the moving average obtained at S1. After the toner concentration adjustment amount ΔTC is determined, the controller 100 calculates the target value adjustment amount $\Delta Vt_{ref}$ according to formula 3 shown below using the sensitivity SV of the magnetic permeability sensor 26 obtained at S3.

$$\Delta Vt_{ref}=(-1)\times\Delta TC\times SV \quad \text{FORMULA 3}$$

The target value adjustment amount $\Delta Vt_{ref}$ thus calculated is stored in the RAM 103. It is to be noted that the target value adjustment amount $\Delta Vt_{ref}$ is calculated separately for each color.

Table 1 shown below is an example of the look-up table when the sensitivity SV of the magnetic permeability sensor 26 is 0.3.

TABLE 1

| Image area ratio moving average (%) | ΔTC (V/wt %) | $\Delta Vt_{ref}$(V) |
|---|---|---|
| M(i) < 1 | 0.5 | −0.15 |
| 1 =< M(i) < 2 | 0.4 | −0.12 |
| 2 =< M(i) < 3 | 0.3 | −0.09 |
| 3 =< M(i) < 4 | 0.2 | −0.06 |
| 4 =< M(i) < 6 | 0.0 | 0.00 |
| 6 =< M(i) < 7 | −0.1 | 0.03 |
| 7 =< M(i) < 8 | −0.2 | 0.06 |
| 8 =< M(i) < 9 | −0.3 | 0.09 |
| 9 =< M(i) < 10 | −0.4 | 0.12 |
| 10 =< M(i) < 20 | −0.5 | 0.15 |
| 20 =< M(i) < 30 | −0.6 | 0.18 |
| 30 =< M(i) < 40 | −0.7 | 0.21 |
| 40 =< M(i) < 50 | −0.8 | 0.24 |
| 50 =< M(i) < 60 | −0.9 | 0.27 |
| 60 =< M(i) < 70 | −1.0 | 0.30 |
| 70 =< M(i) < 80 | −1.0 | 0.30 |
| 80 =< M(i) | −1.0 | 0.30 |

A method of creating the look-up table used in the present embodiment is described below.

Figure 8:
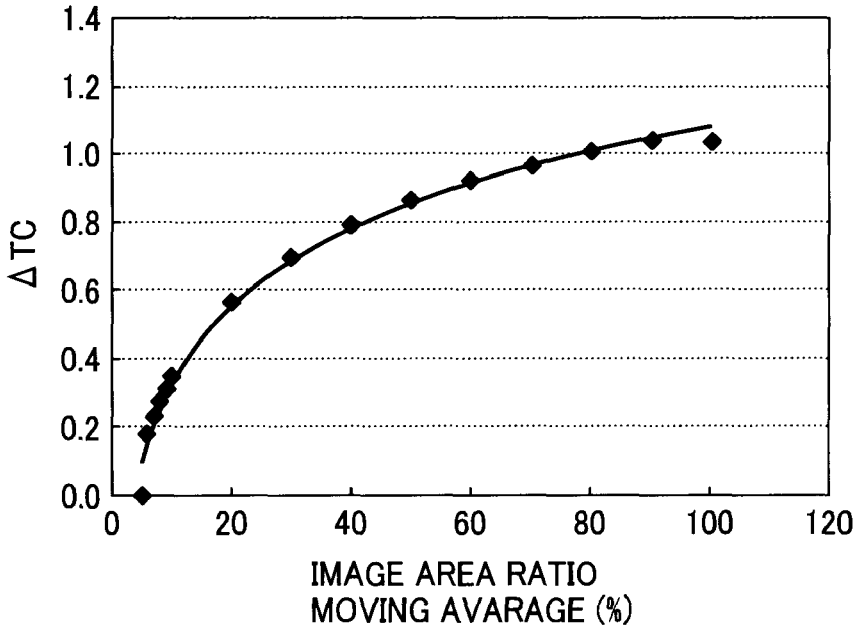
FIG. 8 is a graph illustrating a relation between an image area ratio moving average and a toner concentration adjustment amount.

FIG. 8 is a graph in which a horizontal axis shows the moving average (%) of image area ratio and a vertical axis shows the toner concentration adjustment amount (wt%) in a minus direction to change the toner concentration so as to maintain constant development γ with respect to a standard toner concentration.

According to the graph shown in FIG. 8, for example, when the moving average is 80%, development γ is kept constant by controlling the toner concentration with toner concentration adjustment amount ΔTC set to −1 (wt %). Because the toner concentration adjustment amount ΔTC corresponding to the image area ratio moving average can be approximated more closely logarithmically, the toner concentration adjustment amount ΔTC in the look-up table was determined by using log approximation. In the present embodiment, the toner concentration adjustment amount ΔTC and the target output value $Vt_{ref}$ are changed for every percent of the moving average when the moving average is less than 10% and every 10% when the moving average is 10% or more, as shown in TABLE 1. Such intervals to set these adjustment amounts can be changed according to characteristics of the developer and/or the developing device.

Further, because usage conditions of the developer depend on color, conditions of the target output value adjustment, such as intervals to set these adjustment amounts and timing to perform adjustment, may be set for each color. In particular, it is preferable to set maximum adjustment amount for each color. In this case, for example, a formula shown below is used instead of formula 3 described above.

$$\Delta Vt_{ref}=(-1)\times\Delta TC\times SV\times COEF1 \quad \text{FORMULA 4}$$

wherein COEF1 is a color correction coefficient.

After the target value adjustment amount $\Delta Vt_{ref}$ is determined based on the look-up table at S7 as described above, at S8 the controller 100 calculates an adjusted target output value $Vt_{ref}$3 for each color using formula 5 shown below based on the target value adjustment amount $\Delta Vt_{ref}$ obtained at S7 and the $Vt_{ref}$1 obtained at S2.

$$Vt_{ref}3=Vt_{ref}1+\Delta Vt_{ref} \quad \text{FORMULA 5}$$

At S9, the controller 100 checks whether or not the adjusted target output value $Vt_{ref}$3 is within a predetermined or desirable range. More specifically, the controller 100 sets the target output value $Vt_{ref}$ to an upper limit of the range when the adjusted target output value $Vt_{ref}$3 exceeds the range and to a lower limit when the adjusted target output value $Vt_{ref}$3 is below the range. When the adjusted target output value $Vt_{ref}$3 is between the upper limit and the lower limit, the controller 100 sets the target output value $Vt_{ref}$ to the adjusted target output value $Vt_{ref}$3. The controller 100 stores the target output value $Vt_{ref}$ thus adjusted in the RAM 103 as a current target output value at S10.

It is preferable that the timing with which the target output value is adjusted be each time after one developing process ends before a subsequent developing process starts in continuous image forming. By adjusting the target output value after each developing process ends and before a subsequent developing process starts, the toner concentration can be controlled based on the target output value adjusted for each output sheet even in continuous image forming.

It is to be noted that changes in the charge characteristics of the toner, that is, how easily the toner is charged, can be caused by factors other than the toner replacement amount. For example, the toner charge characteristics change over time and/or with changes in environmental conditions.

When the toner in the developing device becomes more easily charged over time and/or with changes in environmental conditions, the toner can be excessively charged and its average charge amount increases before a subsequent image formation. By contrast, when the toner in the developing device becomes less easily charged, the toner cannot be sufficiently charged and its average charge amount decreases before a subsequent image formation. That is, the average toner charge in the developing device might be different in the subsequent image formation depending on its charge characteristics even if the toner replacement amount for a given time period is identical.

Moreover, the average toner charge changes when a target toner concentration in the developing device is increased or decreased.

As described above, the toner concentration adjustment amount ΔTC is determined based on an image area ratio moving average of several sheets or several tens of sheets that are output most recently during a given time period.

When the target toner concentration is adjusted to increase, toner is supplied so as to increase the toner concentration in the developing device. For example, images of lower image area ratios are continuously output after images of higher image area ratios are continuously output, the image area ratio moving average decreases for each output image. Therefore, if the image area ratio moving average is calculated based on a smaller number of sheets, differences in the moving average is larger, causing a rapid increase in the target toner concentration. As a result, a larger amount of toner is supplied, which decreases the average toner charge in the developing device for a subsequent image formation and increases image density.

Further, when the toner concentration is suddenly increased, probability of the toner to contact the carrier suddenly decrease and charging toner becomes difficult. In this case, it takes longer time to raise the average toner charge to a preferable level.

Therefore, when the target toner concentration is increased, it is preferable to set the number of output sheets used to calculate the image area ratio moving average to a larger number so as to reduce differences in the moving average. By reducing differences in the moving average, the target toner concentration is gradually increased and the amount of toner supplied to the developing device during a given time period is reduced, thus reducing a decrease in image density.

By contrast, when the toner concentration is adjusted to decrease, the amount of toner supplied to the developing device is decreased. In this case, if the image area ratio moving average is calculated based on a larger number of sheets and the target toner concentration is gradually adjusted, the following phenomenon will occur.

For example, in a case in which images of higher image area ratios are continuously output after images of lower image area ratios are continuously output, the amount of toner supplied to the developing device is gradually decreased if the target toner concentration is gradually decreased. In this case, the decrease in the toner supply is insufficient and an excessive amount of toner is supplied to the developing device. Further, because the amount of toner in the developing device is larger, the probability of toner-to-carrier contact is lower and the newly supplied toner is not sufficiently charged, which decreases the average toner charge in the developing device for a subsequent image formation and increases image density.

Therefore, it is preferable to change the toner concentration more rapidly when a reference value to control the toner concentration is adjusted so as to decrease the toner concentration, compared with a case in which the reference value is adjusted so as to increase the toner concentration.

As described above, for a constant image density, the speed of increase of the target toner concentration is different from the speed of decrease of the target toner concentration.

To confirm the target output value adjustment illustrated in FIG. 7, experiments 1 through 3, described below, were performed with different development γ.

EXPERIMENT 1

In experiment 1, the target output value adjustment described above was performed under standard environmental conditions of a temperature of 23° C. and a humidity of 65%. An initial development γ, which was a value of development γ before experiment 1 was started, was within a range of from 0.6 mg/cm$^2$/kV to 1.2 mg/cm$^2$/kV. This experiment 1 was to check image density consistency when the image area ratio is increased by 20% from zero for every 20 sheets. In experiment 1, the image area ratio moving average was calculated using formula 1 described above, the cumulative number of sheets N was set to 10, and the target image density was set to 1.4.

Figure 9:
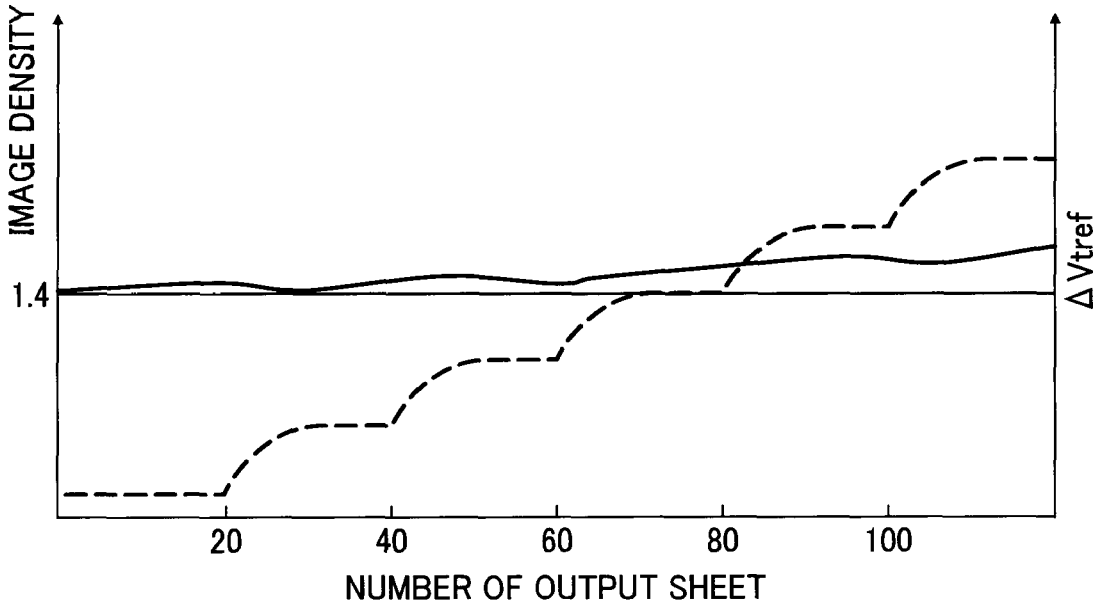
FIG. 9 is a graph illustrating results of experiment 1.

FIG. 9 is a graph illustrating results of experiment 1. Although FIG. 9 illustrates the results when the initial development γ was within the range of from 0.6 mg/cm$^2$/kV to 1.2 mg/cm$^2$/kV, similar results were achieved even when the initial development γ was out of this range. In FIG. 9, a horizontal axis shows the number of output sheets, a right vertical axis shows the target value adjustment amount $\Delta Vt_{ref}$, and a left vertical axis shows image density (ID). In the graph shown in FIG. 9, the target value adjustment amount $\Delta Vt_{ref}$ is shown by a dashed line and the image density is shown by a solid line.

As illustrated in FIG. 9, a substantially constant image density was maintained for each image area ratio by performing the target output value adjustment illustrated in FIG. 7. That is, in a developing system used in experiments 1 through 3, image density was kept substantially constant by performing the target output value adjustment illustrated in FIG. 7 when development γ was within the range of from 0.6 mg/cm$^2$/kV to 1.2 mg/cm$^2$/kV.

EXPERIMENT 2

Figure 10:
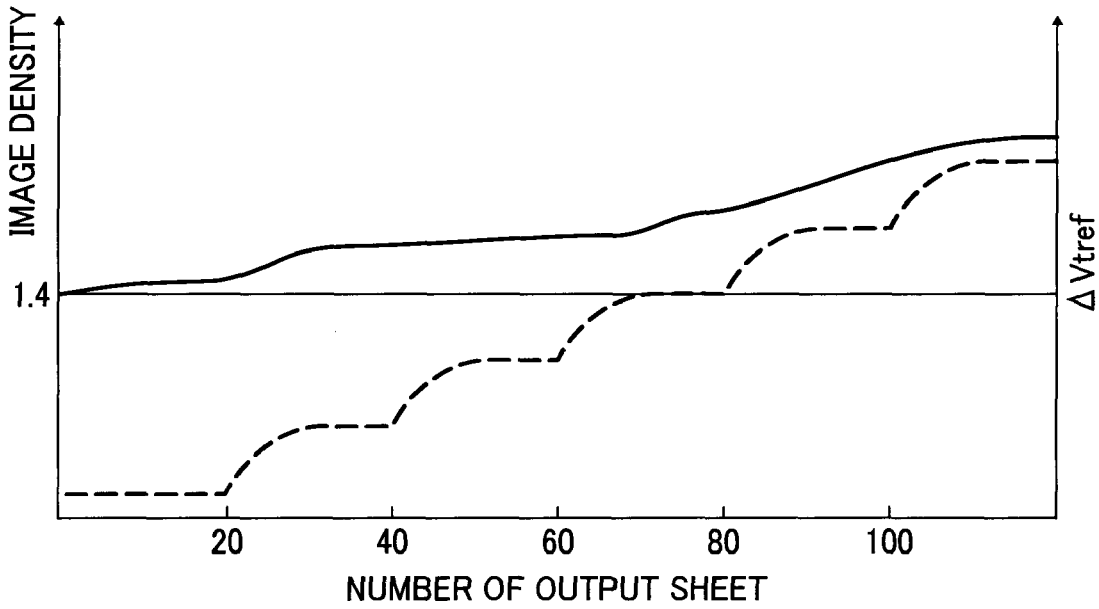
FIG. 10 is a graph illustrating results of experiment 2.

In experiment 2, the target output value adjustment was performed under conditions similar to those of experiment 1 with an initial development γ of 1.8 mg/cm$^2$/kV. FIG. 10 is a graph illustrating results of experiment 2.

As illustrated in FIG. 10, in a case in which the development γ was as high as 1.8 mg/cm$^2$/kV, image density increased when the image area ratio was 20% or more.

A reason for the rise in image density along with the increase in the image area ratio when development γ is as high as 1.8 mg/cm$^2$/kV is presumed to be as follows: When the development γ is higher, the toner in a developing system is not charged relatively easily and thus it is insufficiently charged. In this state, developability is higher, and accordingly development γ is higher. In such a state in which the toner is not charged relatively easily, the amount of the toner insufficiently charged increases in the developing system when images having higher image area ratios are output and a larger amount of toner is supplied to the developing system. Thus, image density increases as the image area ratio of the output images increases.

Therefore, when development γ (developability) is higher and the toner is not charged relatively easily, the toner concentration in the developing system should be decreased from that of experiment 1 so as to charge the toner better by increasing probability of toner-to-carrier contact.

EXPERIMENT 3

Figure 11:
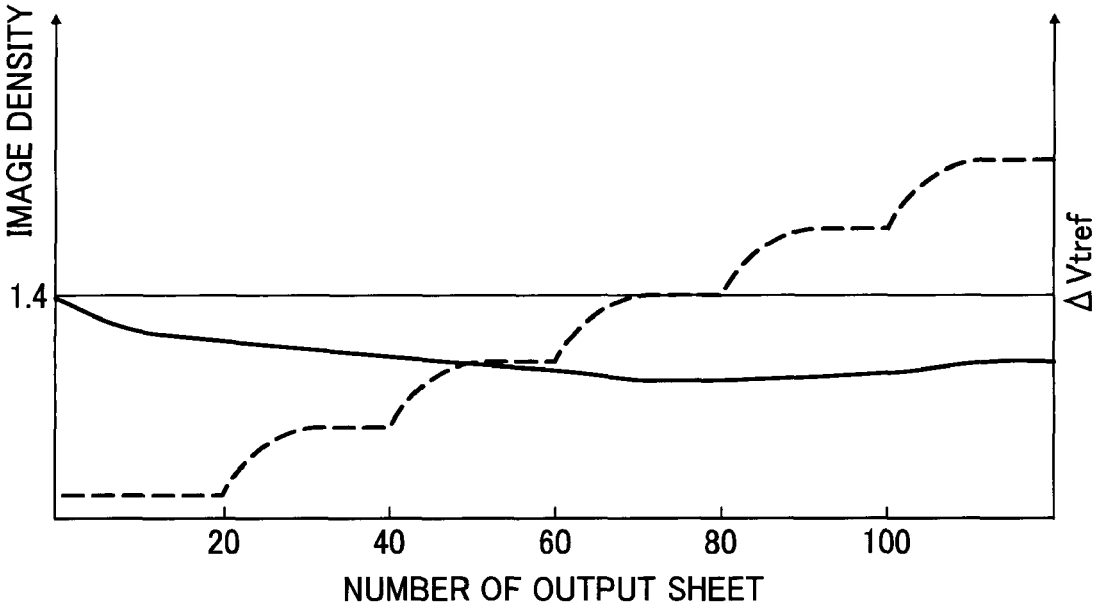
FIG. 11 is a graph illustrating results of experiment 3.

In experiment 3, the target output value adjustment was performed under conditions similar to those of experiment 1, and the initial development γ was 0.4 mg/cm$^2$/kV. FIG. 11 is a graph illustrating results of experiment 3.

As illustrated in FIG. 11, image density decreased when the image area ratio is within a rage of from zero to 50%.

Presumably, the decrease in image density in a case in which development γ is as low as 0.4 mg/cm$^2$/kV and the image area ratio is lower occurs because the toner in the developing system is easily charged and thus sufficiently charged when the development γ is lower, developability decreases, and accordingly development γ decreases. When images with lower image area ratios are output in a state in which the toner in the developing system is easily charged, the amount of toner supplied to the developing system is lower, causing the toner to be excessively charged in the developing system before a subsequent image formation. Thus, image density decreases when the image area ratio of the output images is lower.

Therefore, when development γ (developability) is lower and the toner is easily charged, the toner concentration in the developing system should be increased from that of experiment 1 so that the toner is not excessively charged by decreasing the probability of toner-to-carrier contact.

It is to be noted that, although image density was substantially constant in the developing system used in experiments 1 through 3 when development γ was within the range of from 0.6 mg/cm$^2$/kV to 1.2 mg/cm$^2$/kV, the range of development γ depends on the configuration of a developing device.

Figure 12:
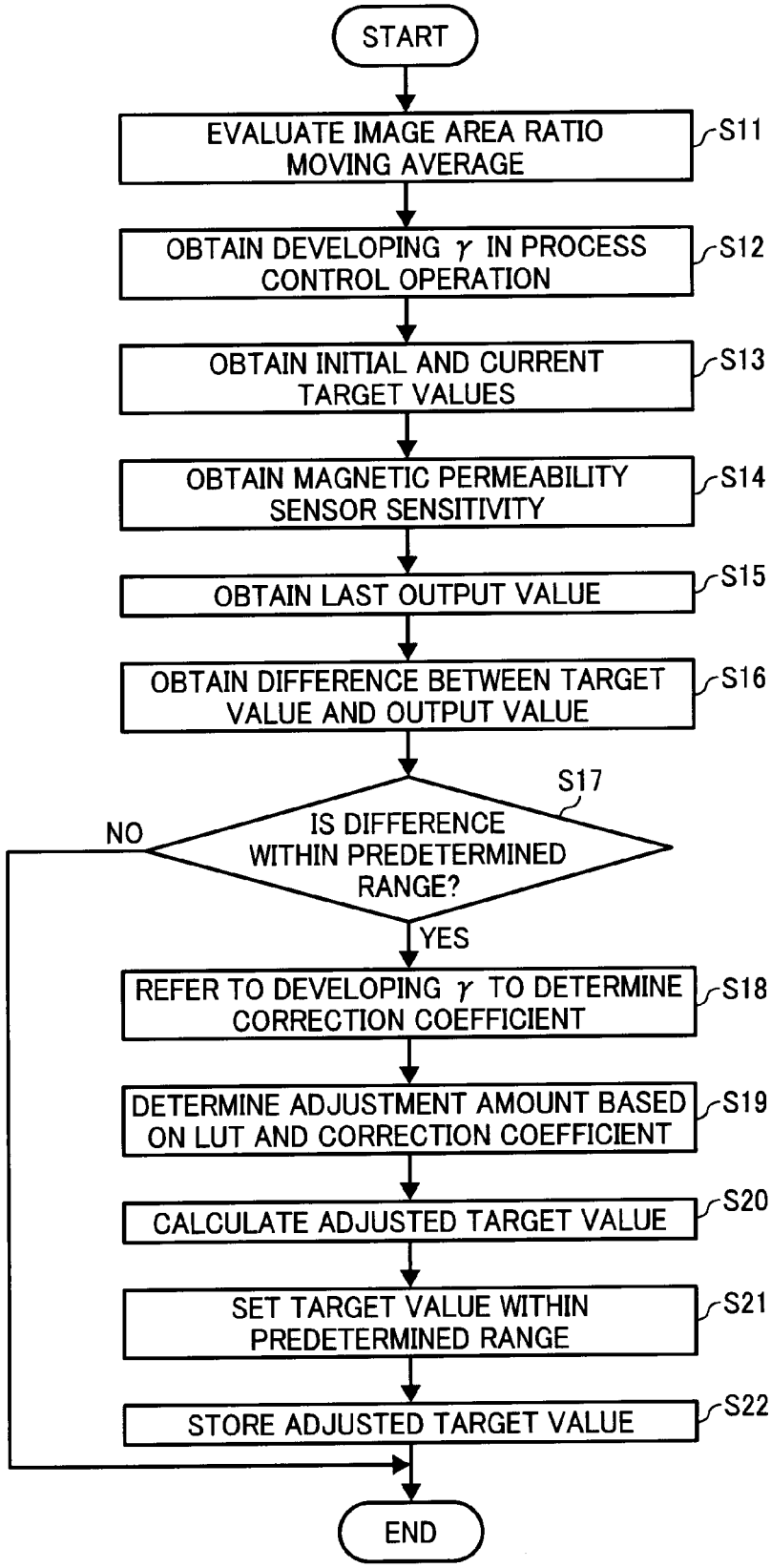
FIG. 12 illustrates a sequence of processes performed in another target output value adjustment.

FIG. 12 illustrates a sequence of processes performed in target output value adjustment according to another illustrative embodiment.

In view of the results of experiments 1 through 3, in the target output value adjustment illustrated in FIG. 12, the target output value $Vt_{ref}$ is adjusted based on image area ratio, which is the first information to determine the toner replacement amount, and development γ (developability), which is second information to determine toner charge characteristics in the developing system.

In the present target output value adjustment, after calculating the image area ratio moving average at S11, the controller 100 obtains a development γ that is calculated in a process control operation at S12, as illustrated in FIG. 12.

It is to be noted that in the target output value adjustment illustrated in FIG. 12, the process control operation is performed each time after 100 sheets are output.

After the development γ is obtained, the controller 100 further obtains an initial target output value $Vt_{ref}$1 and a current target output value $Vt_{ref}$2 at S13 similarly to the target output value adjustment illustrated in FIG. 7. The controller 100 further obtains a sensitivity SV of the magnetic permeability sensor 26 at S14 and a previous output value Vt at S15, and then calculates a difference D1 by deducting the current target output value $Vt_{ref}$2 from the previous output value Vt at S16. At S17, the controller 100 determines whether or not the difference D1 is within a predetermined or desirable range.

When the difference D1 is within a predetermined or desirable range (YES at S17), the controller 100 determines a correction coefficient COEFa to adjust the toner concentration adjustment amount ΔTC at S18, with reference to the development γ obtained at S12. In the target output value adjustment illustrated in FIG. 12, the correction coefficient COEFa is set to −0.2 wt % when the development γ exceeds a proper range and to 0.2 wt % when the development γ is below the proper range. With this correction coefficient COEFa, when the development γ exceeds the proper range, the toner concentration is decreased from the toner concentration used when the development γ is within the proper range. By contrast, when the development γ is below the proper range, the toner concentration is increased from the toner concentration used when the development γ is within the proper range.

It is to be noted that the correction coefficient COEFa is set separately for each developing system.

At S19, the controller 100 determines the target value adjustment amount $\Delta Vt_{ref}$ based on a look-up table (LUT) and the correction coefficient COEFa. More specifically, the controller 100 refers to the look-up table and determines the toner concentration adjustment amount ΔTC corresponding to the calculated image area ratio moving average, similarly to the target value adjustment illustrated in FIG. 7. After determining the toner concentration adjustment amount ΔTC, the controller 100 adjusts this toner concentration adjustment amount ΔTC by using the correction coefficient COEFa determined at S18 and then calculates the target value adjustment amount $\Delta Vt_{ref}$ according to formula 6 shown below by using the sensitivity SV of the magnetic permeability sensor 26.

$$\Delta Vt_{ref}=(-1)\times(\Delta TC+COEFa)\times SV \qquad \text{FORMULA 6}$$

The target value adjustment amount $\Delta Vt_{ref}$ is calculated for each color and stored in the RAM 103.

After the target value adjustment amount $\Delta Vt_{ref}$ is determined based on the look-up table and the correction coefficient COEFa as described above, the controller 100 calculates an adjusted target output value $Vt_{ref}$3 for each color according to formula 5 and then checks whether or not the adjusted target output value $Vt_{ref}$3 is within a predetermined or desirable range at S21. Similarly to the target value adjustment illustrated in FIG. 7, the controller 100 sets the target output value $Vt_{ref}$ to one of an upper limit of the range, a lower limit of the range, and the adjusted target output value $Vt_{ref}$3, and stores the target output value $Vt_{ref}$ in the RAM 103 at S22.

In the present embodiment, because the process control operation is performed each time after 100 sheets are output, the toner concentration adjustment amount ΔTC is adjusted each time after 100 sheets are output.

Further, although the toner concentration adjustment amount ΔTC is adjusted by using the correction coefficient COEFa based on development γ, which is information to determine the toner charge characteristics in the developing device, so as to determine the target value adjustment amount $\Delta Vt_{ref}$ in the description above, the target value adjustment amount $\Delta Vt_{ref}$ can be determined in a different manner. For example, different look-up tables may be prepared for cases in which development γ is within a proper range, over the range, and below the range, and stored in the RAM 103 so that the target value adjustment amount $\Delta Vt_{ref}$ is determined according to the look-up table suitable for the development γ. Also in this case, the target value adjustment amount $\Delta Vt_{ref}$ determined with reference to the look-up table for a lower development γ is smaller than the target value adjustment amount $\Delta Vt_{ref}$ used when development γ is within a proper range so as to set the toner concentration to a higher value, even if the image area ratio moving average is identical. By contrast, the target value adjustment amount $\Delta Vt_{ref}$ determined with reference to the look-up table for a higher development γ is larger than the target value adjustment amount $\Delta Vt_{ref}$ used when development γ is within a proper range so as to set the toner concentration to a lower value, even if the image area ratio moving average is identical.

Moreover, although the toner concentration adjustment amount ΔTC is increased or decreased by 0.2 wt % for all image area ratios included in the look-up table in the description above, the correction coefficient thereof can be set differently. For example, because image density increases as the image area ratio moving average increases as illustrated in FIG. 10 when development γ is higher, the correction coefficient COEFa used when the image area ratio moving average is higher may be set to a larger value than that used when the image area ratio moving average is lower. By contrast, because image density decreases when the image area ratio moving average is lower as illustrated in FIG. 11 when development γ is lower, the correction coefficient COEFa may be set to a larger value when the image area ratio moving average is lower than that used when the image area ratio moving average is higher.

It is to be noted that, although only correction coefficients for higher development γ and lower development γ are described above, alternatively, more than two correction coefficients may be used depending on development γ.

Described below is a short running test that was performed to evaluate the target value adjustment illustrated in FIG. 12. In the short running test, 450 sheets were continuously output at a standard linear speed of 120 mm/s and the image area ratio was varied as shown in TABLE 2 shown below.

Figure 13:
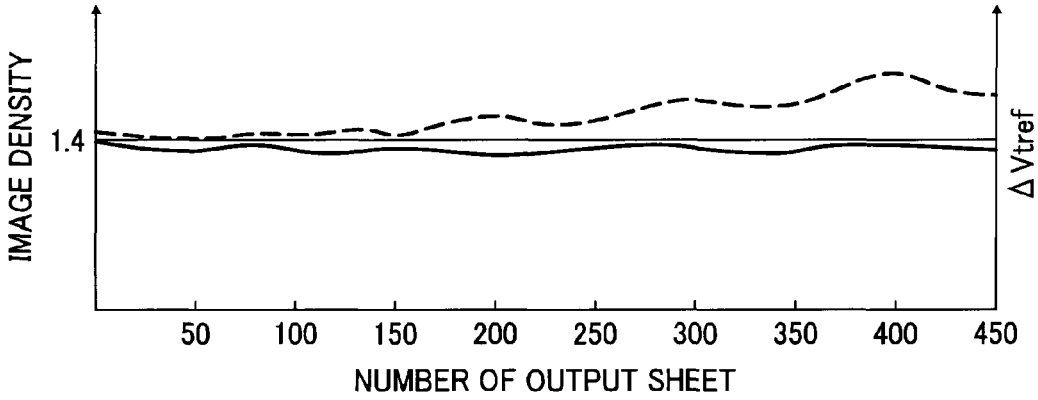
FIG. 13 is a graph illustrating results of the target output value adjustment illustrated in FIG. 12 and a comparative example when initial developing gamma is higher than a proper range.
Figure 14:
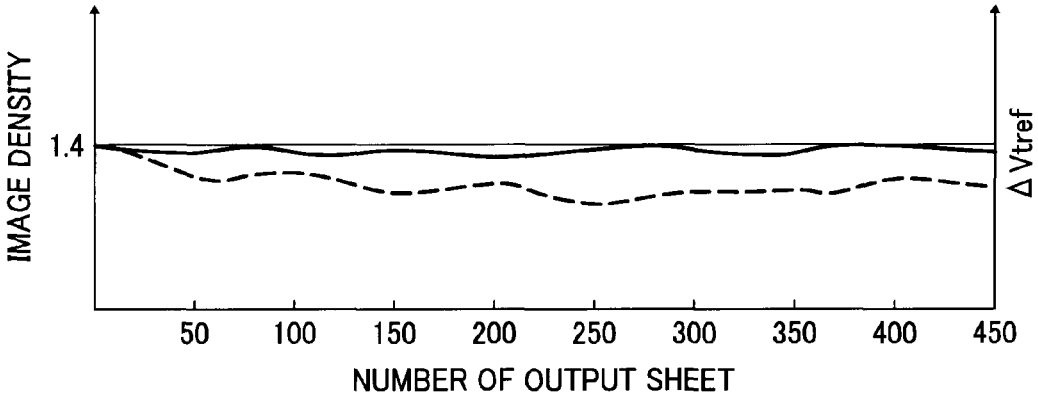
FIG. 14 is a graph illustrating results of the target output value adjustment illustrated in FIG. 12 and the comparative example when initial developing gamma is lower than the proper range.

FIGS. 13 and 14 illustrate results of the short running test when the initial development γ was over the proper range and below the proper range, respectively. In each of FIGS. 13 and 14, a solid line indicates results of the target output value adjustment in which the toner concentration adjustment amount ΔTC was adjusted with respect to development γ as illustrated in FIG. 12, and a dashed line indicates results of a comparative example in which the toner concentration adjustment amount ΔTC was not adjusted with respect to development γ.

TABLE 2

| | Number of output sheets | | | | | | | | |
|---|---|---|---|---|---|---|---|---|---|
| | 0-50 | 50-100 | 100-150 | 150-200 | 200-250 | 250-300 | 300-350 | 350-400 | 400-450 |
| Image area ratio (%) | 5 | 10 | 5 | 30 | 5 | 50 | 5 | 80 | 5 |

Referring to FIG. 13, in the comparative example whose results are shown by the dashed line, the image density increased along with an increase in the image area ratio and was higher than the target image density of 1.4 throughout the test. By contrast, the image density was kept close to the target image density of 1.4 throughout the test by performing the target output value adjustment illustrated in FIG. 12, according to its results shown by the solid line in FIG. 13.

Therefore, when development γ is over the proper range, image density can be kept substantially constant by deducting correction coefficient COEFa from the toner concentration adjustment amount ΔTC and setting the toner concentration to a lower value than that used when development γ is within the proper range, as in the target output value adjustment illustrated in FIG. 12.

Referring to FIG. 14, in the comparative example whose results are shown by the dashed line, image density decreased along with a decrease in the image area ratio and was lower than the target image density of 1.4 throughout the test. By contrast, image density was kept close to the target image density of 1.4 throughout the test by performing the target output value adjustment illustrated in FIG. 12, according to its results shown by the solid line in FIG. 14.

Therefore, when development γ is below the proper range, image density can be kept substantially constant by adding the correction coefficient COEFa to the toner concentration adjustment amount ΔTC and setting the toner concentration to a higher value than that used when development γ is within the proper range, as in the target output value adjustment illustrated in FIG. 12.

Further, although development γ, which corresponds to developability, is used as the second information to determine toner charge characteristics in the developing device in the description above, the toner charge characteristics may be determined in a different manner. For example, toner charge characteristics can be determined based on environmental conditions in the developing device.

Under lower temperature and lower humidity environmental conditions, image density decreases because the toner in the developing device is easily charged. By contrast, under higher temperature and higher humidity environmental conditions, image density increases because the toner in the developing device is not charged relatively easily.

Therefore, the toner concentration adjustment amount ΔTC can be adjusted based on detected environmental conditions inside the image forming apparatus. That is, when the detected environmental conditions are lower temperature and lower humidity environmental conditions in which, for example, temperature is 10° C. and humidity is 15%, the correction coefficient COEFa is added to the toner concentration adjustment amount ΔTC. With this adjustment, the toner concentration in the developing device is increased under the lower temperature and lower humidity environmental conditions from the toner concentration used under the normal environmental conditions. Accordingly, the probability of toner-to-carrier contact is decreased so that the toner is less easily charged. As a result, the toner concentration can be prevented from decreasing under the lower temperature and lower humidity environmental conditions detected inside the image forming apparatus.

By contrast, when detected environmental conditions are higher temperature and higher humidity environmental conditions in which, for example, temperature is 27° C. and humidity is 80%, the correction coefficient COEFa is deducted from the toner concentration adjustment amount ΔTC. By deducting the correction coefficient COEFa from the toner concentration adjustment amount ΔTC, the toner concentration in the developing device is decreased to a lower value under higher temperature and higher humidity environmental conditions than the toner concentration used under the standard environmental conditions. Accordingly, the probability of toner-to-carrier contact is increased and toner charge characteristics are enhanced, thus preventing or reducing a rise in image density under the higher temperature and higher humidity environmental conditions detected inside the image forming apparatus.

It is to be noted that the environmental conditions may be determined based on detection results obtained by a temperature and humidity sensor provided along the sheet transport path so as to determine transfer current as illustrated in FIG. 1, although it is preferable to locate the temperature and humidity sensor at a position close to the developing device 20.

Further, toner charge characteristics in the developing device tend to change over time. For example, while the toner is used over time, an additive that is externally added to toner particles may separate out and leave toner particles behind, which decreases overall fluidity of the toner and consequently decreases the probability of toner-to-carrier contact. Moreover, toner charge characteristics deteriorate over time and the toner becomes less easily charged. As the charge characteristic of the toner thus decreases, image density increases.

Therefore, alternatively, the toner concentration adjustment amount ΔTC may be adjusted based on changes in the characteristics of the toner over time as the second information used to determine toner charge characteristics in the developing device. When the characteristics of the toner change over time, the correction coefficient COEFa is deducted from the toner concentration adjustment amount ΔTC so as to decrease the toner concentration in the developing device. With this adjustment, the probability of toner-to-carrier contact can be increased and the toner charge characteristics in the developing device are enhanced, thus maintaining a consistent image density.

It is to be noted that changes in characteristics of toner over time can be determined based on the number of output sheets counted by the sheet counter 63 illustrated in FIG. 3. That is, a reference number of output sheets used to determine that toner charge characteristics have deteriorated is preliminary determined by experiment. When the number of output sheets reaches the predetermined reference number, the controller 100 illustrated in FIG. 3 determines that toner charge characteristics have deteriorated and detects the correction coefficient COEFa from the toner concentration adjustment amount ΔTC.

Alternatively, toner charge characteristics may be determined comprehensively by using two or more types of the information used to determine changes in the characteristics of the toner over time, that is, the information to determine environmental conditions, and the information to determine developing γ. Based on the toner charge characteristics thus determined, the correction coefficient COEFa to be added to or deducted from the toner concentration adjustment amount ΔTC may be determined.

Moreover, although in the description above, the target value adjustment amount $\Delta Vt_{ref}$ is changed by adding or deducting the correction coefficient COEFa to or from the toner concentration adjustment amount ΔTC, alternatively, the target value adjustment amount $\Delta Vt_{ref}$ may be changed by adding or deducting a correction coefficient thereto or therefrom. Alternatively, the target value adjustment amount $\Delta Vt_{ref}$ may be changed by being divided or multiplied by a correction coefficient.

As described above, toner charge characteristics can be determined more accurately based on detection of developing γ in the target value adjustment. Alternatively, toner charge characteristics can be determined based on environmental conditions in the developing device or changes in characteristics of the developer. When toner charge characteristics is determined based on the environmental conditions or changes in characteristics of the developer, forming toner patterns is unnecessary, differently from the case in which toner charge characteristics is determined based on developing γ.

Further, the controller 100 serves as a toner concentration control reference value changer and changes the adjustment amount $\Delta Vt_{ref}$ of the target output value $Vt_{ref}$, which is the toner concentration control reference value determined based on the information related to the toner replacement amount, based on the information related to toner charge characteristics. Therefore, the target output value $Vt_{ref}$ can be adjusted so as to maintain a constant developability of the developing device.

Moreover, when the controller 100 determines that the toner is relatively easily charged, the adjustment amount $\Delta Vt_{ref}$ is changed so as to increase the target toner concentration in the developing device. With this adjustment, the toner is prevented from being excessively charged and image density can be kept constant. Further, in the case in which the toner is relatively easily charged, image density is more likely to decrease when the toner replacement amount (the image area ratio moving average) is smaller. Therefore, the decrease in image density can be prevented or reduced even when the toner is relatively easily charged by setting the target value adjustment amount $\Delta Vt_{ref}$ corresponding to a lower image area ratio moving average to a lager amount than the adjustment amount $\Delta Vt_{ref}$ corresponding to a larger image area ratio moving average.

By contrast, when the toner is not relatively easily charged, the toner concentration should be lowered from that used under standard conditions even if the image area ratio moving average remains the same. That is, when the controller 100 determines that the toner is not relatively easily charged, the target value adjustment amount $\Delta Vt_{ref}$ is changed so as to decrease the toner concentration. By lowering the toner concentration, the probability of toner-to-carrier contact is increased and the toner can be charged sufficiently before a subsequent image formation, thus maintaining a constant image density.

Moreover, when the toner is not relatively easily charged, image density is more likely to increase when the image area ratio moving average is larger compared to the case in which the image area ratio moving average is smaller. Therefore, when the toner is not relatively easily charged, the target value adjustment amount $\Delta Vt_{ref}$ corresponding to a larger image area ratio moving average is set to a larger amount than a value that corresponds to a smaller image area ratio moving average. With this adjustment, the increase in image density can be prevented or reduced when the image area ratio moving average is larger in the case in which the toner is not relatively easily charged.

Target output value adjustment according to another illustrative embodiment is described below based on experiments A through C, described below, that were performed to confirm the target output value adjustment illustrated in FIG. 7.

EXPERIMENT A

Figure 15:
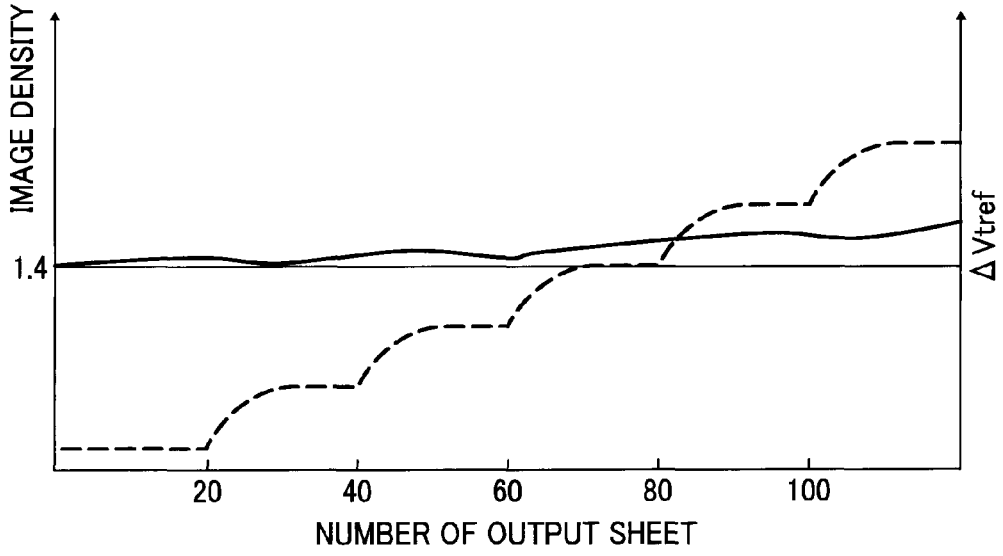
FIG. 15 is a graph illustrating results of experiment A.

In experiment A, the target output value adjustment was performed under the standard environmental conditions of a temperature of 23° C. and a humidity of 65%. This experiment A was to check image density consistency when the image area ratio was increased by 20% from zero for every 20 sheets. The image area ratio moving average was calculated using formula 1, the cumulative number of sheets N was set to 10, and the target image density was set to 1.4. Results of experiment A is shown in FIG. 15, in which a horizontal axis shows the number of output sheets, a right vertical axis shows the target value adjustment amount $\Delta Vt_{ref}$, and a left vertical axis shows image density. The target value adjustment amount $\Delta Vt_{ref}$ is shown by a dashed line, and image density is shown by a solid line.

As illustrated in FIG. 15, when the target output value $\Delta Vt_{ref}$ was increased from a lower value, that is, the toner concentration is decreased from a higher value, image density was kept substantially constant by performing the target output value adjustment illustrated in FIG. 7.

EXPERIMENT B

In experiment B, environmental conditions and the developing system used were identical with those of experiment A. Experiment B was to check image density consistency when the target output value adjustment was performed under a condition that the image area ratio was decreased by 20% from 100 for every 20 sheets. Results of experiment B is shown in FIG. 16.

Figure 16:
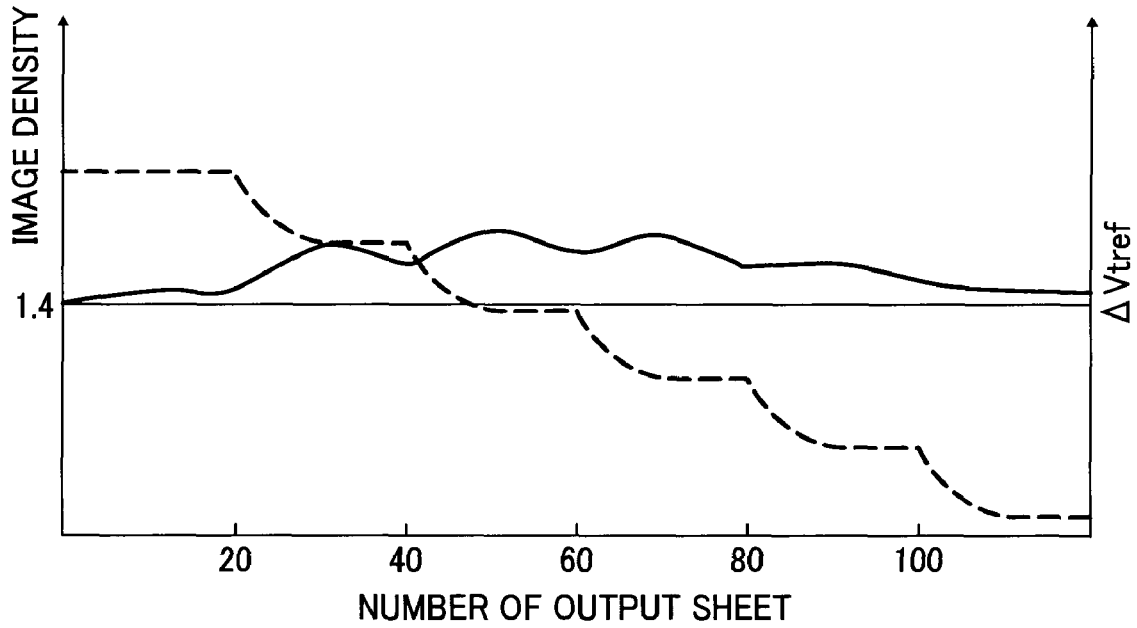
FIG. 16 is a graph illustrating results of experiment B.

As illustrated in FIG. 16, in a case in which $\Delta Vt_{ref}$ was decreased from a higher value, that is, the toner concentration is increased from a lower value, image density was higher than the target value of 1.4 when the number of output sheets was in a range of from about 30 to 80.

It is clear from the results of experiment B that in the case in which the target output value $\Delta Vt_{ref}$ is decreased from a higher value, that is, the toner concentration is increased from a lower value, image density consistency is insufficient in the developing system identical with that of experiment A.

EXPERIMENT C

In experiment C, environmental and other conditions were identical with those of experiment B. Experiment C used a developing system in which the cumulative number of sheets N used to calculate the image area ratio moving average was set to 20 and image density consistency was checked. Results of experiment C is shown in FIG. 17.

Figure 17:
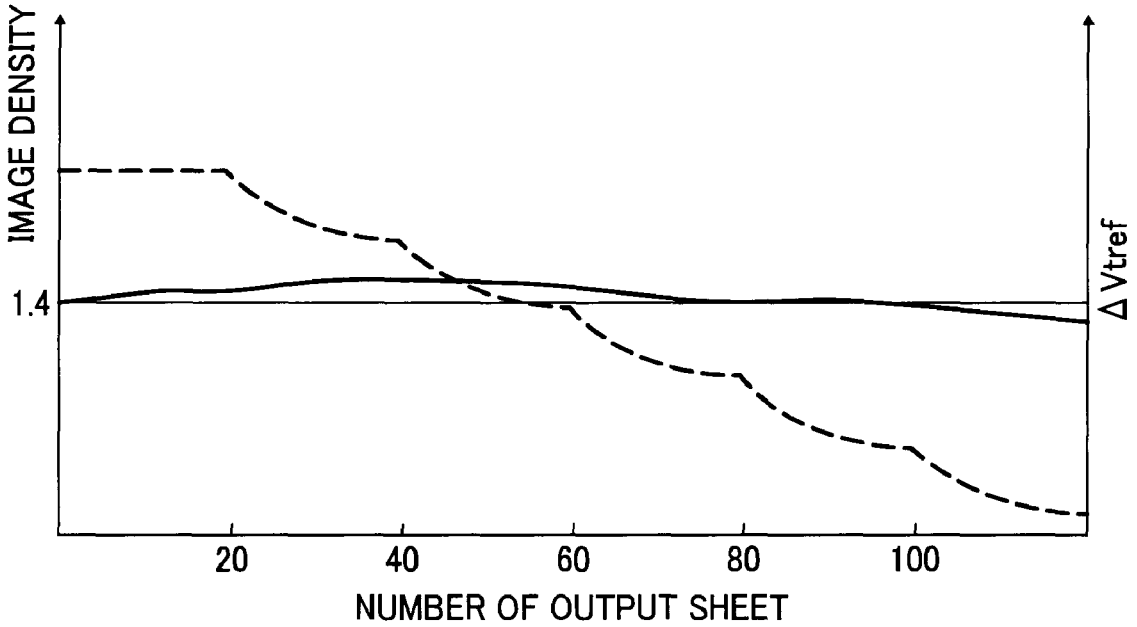
FIG. 17 is a graph illustrating results of experiment C.

As illustrated in FIG. 17, in a case in which the cumulative number of sheets N was set to 20 and the target value adjustment amount $\Delta Vt_{ref}$ was decreased from a higher value, that is, the toner concentration is increased from a lower value, image density was kept substantially constant. Thus, image density consistency was sufficient.

Described below is a reason for the fact that image density was more consistent in experiment C in which the cumulative number of sheets N was set to 20 compared with experiment B in which the cumulative number of sheets N was set to 10.

As illustrated in FIG. 16, in the developing system used in experiment B (cumulative number of sheets is 10), for example, after the number of output sheets reached 20 and the image area ratio was decreased from 100% to 80%, the target value adjustment amount $\Delta Vt_{ref}$ suddenly decreased and then became stable at a given value. Along with the sudden decrease in the target value adjustment amount $\Delta Vt_{ref}$, the toner concentration suddenly increased. By contrast, as illustrated in FIG. 17, in the developing system used in experiment C (cumulative number of sheets is 20), after the number of output sheets reached 20 and the image area ratio was decreased to 80%, the target value adjustment amount $\Delta Vt_{ref}$ gradually decreased and the toner concentration was gradually increased. This was because the target value adjustment amount $\Delta Vt_{ref}$ was determined based on the image area ratio moving average with reference to the look-up table in which the image area ratio moving averages were correlated with target value adjustment amounts $\Delta Vt_{ref}$ in the target value adjustment illustrated in FIG. 7.

For example, in the case in which the cumulative number of sheets N is 10, when the number of output sheets reaches 20 and the image area ratio is decreased from 100% to 80%, the target value adjustment amount $\Delta Vt_{ref}$ decreases until the number of output sheets reaches 30 with which the image area ratio moving average corresponds to the image area ratio of 80%. While the number of output sheets increases from 30 to 40, the target value adjustment amount $\Delta Vt_{ref}$ remains that value.

By contrast, in the case in which the cumulative number of sheets N is 20, the target value adjustment amount $\Delta Vt_{ref}$ continues to decrease until the number of output sheets reaches 40 with which the image area ratio moving average corresponds to the image area ratio of 80%.

That is, when the cumulative number of sheets is 10, the target value adjustment amount $\Delta Vt_{ref}$ is set to every value in the look-up table that corresponds to the image area ratio moving average within a range of from 80% to 100% while the number of output sheets increases by 10 from 20 to 30. By contrast, when the cumulative number of sheets is 20, the target value adjustment amount $\Delta Vt_{ref}$ is set to all of those values while the number of output sheets increases by 20 from 20 to 40. Therefore, the toner concentration is stabilized at a given vale while the number of output sheets increased by 10 in experiment B and 20 in experiment C. That is, the speed with which the target value adjustment amount $\Delta Vt_{ref}$ is changed (change speed) is lower in experiment C than in experiment B. A sudden decrease in the target value adjustment amount $\Delta Vt_{ref}$ can be prevented or reduced by increasing the cumulative number of sheets N used to calculate the moving average from 10 to 20 so as to lower the change speed. The change speed is expressed by $$V_H = Vt_{ref}C/N_X$$

wherein $V_H$ is the change speed, $Vt_{ref}C$ is an amount with which the target value adjustment amount $\Delta Vt_{ref}$ is changed, and $N_X$ is the number of image formation (image formation number) required to stabilize the target output value $Vt_{ref}$.

It is assumed that the target output value $Vt_{ref}$ is firstly stabilized to a first value $Vt_{ref}A$ by continuously outputting sheets, and then images whose image area ratio is different from the previous image forming is continuously output and the target output value $Vt_{ref}$ is accordingly changed to a second value $Vt_{ref}B$. In this case, the image formation number $N_X$ is the number of image formation required to stabilize the target output value $Vt_{ref}$ to the second value $Vt_{ref}B$.

It is to be noted that the change amount $Vt_{ref}C$ is the value obtained by deducting the second value $Vt_{ref}B$ from the value first value $Vt_{ref}A$.

In the developing system used in experiment B, the image area ratio moving average, which is used to calculate the target value adjustment amount $\Delta Vt_{ref}$, suddenly decreases when the image area ratio is decreased. Therefore, the target value adjustment amount $\Delta Vt_{ref}$ suddenly decreases, causing a sudden increase in the toner concentration. Accordingly, the amount of toner supplied to the developing device is suddenly increased, and the amount of toner that is not sufficiently charged increases in the developing device, and thus image density becomes higher than the target image density. Particularly, when the image area ratio is higher, toner consumption is greater and a larger amount of toner is newly supplied to the developing device, resulting in a sudden increase in the toner concentration. Therefore, image density is likely to exceed the target image density when the image area ratio is higher compared with the case in which the image area ratio is lower.

By contrast, in the developing system used in experiment C, the image area ratio moving average is not suddenly decreased even if the image area ratio is decreased. Because the target value adjustment amount $\Delta Vt_{ref}$ gradually decreases, the toner concentration is gradually increased and accordingly the amount of toner supplied to the developing device is gradually increased. Therefore, the average toner charge can be raised to a preferable level before a subsequent image formation, and thus stabilizing image density.

It is to be noted that it is not preferable to set the cumulative number of sheets N to 20 as in experiment C when the toner concentration decreases. If the cumulative number of sheets N is set to 20, the change speed is slower compared with the case in which the cumulative number of sheets N is set to 10, and thus the toner concentration is slowly decreased. That is, the amount of toner supplied to the developing device is not decreased to a preferable level. Further, because the toner concentration in the developing device is excessive, the toner is not sufficiently charged before a subsequent image formation and the average toner charge is lower. As a result, image density is excessive. Particularly, when the image area ratio moving average is lower and the toner concentration is higher, a larger amount of toner is present in the developing device. If images of a higher image area ratio are continuously output in this state, the amount of toner newly supplied to the developing device is larger. If the toner concentration is decreased slowly, the probability of toner-to-carrier contact is not timely raised to a preferable level, causing image density to increase.

Therefore, the decrease in the average toner charge in the developing device can be better prevented or reduced by setting the cumulative number of sheets N to 10 so as to decrease the target toner concentration immediately, compared with the case in which cumulative number of sheets N is 20 and the target toner concentration is decreased slowly. Thus, the increase in developability can be better prevented or reduced and image density can be prevented from exceeding the target image density.

From the results of experiments A through C, it is preferable that the speed of change of the toner concentration be slower when the toner concentration is increased than when the toner concentration is decreased. That is, it is preferable to change the target output value $Vt_{ref}$ at different speeds when the target toner concentration in the developing device is increased and decreased.

Figure 18:
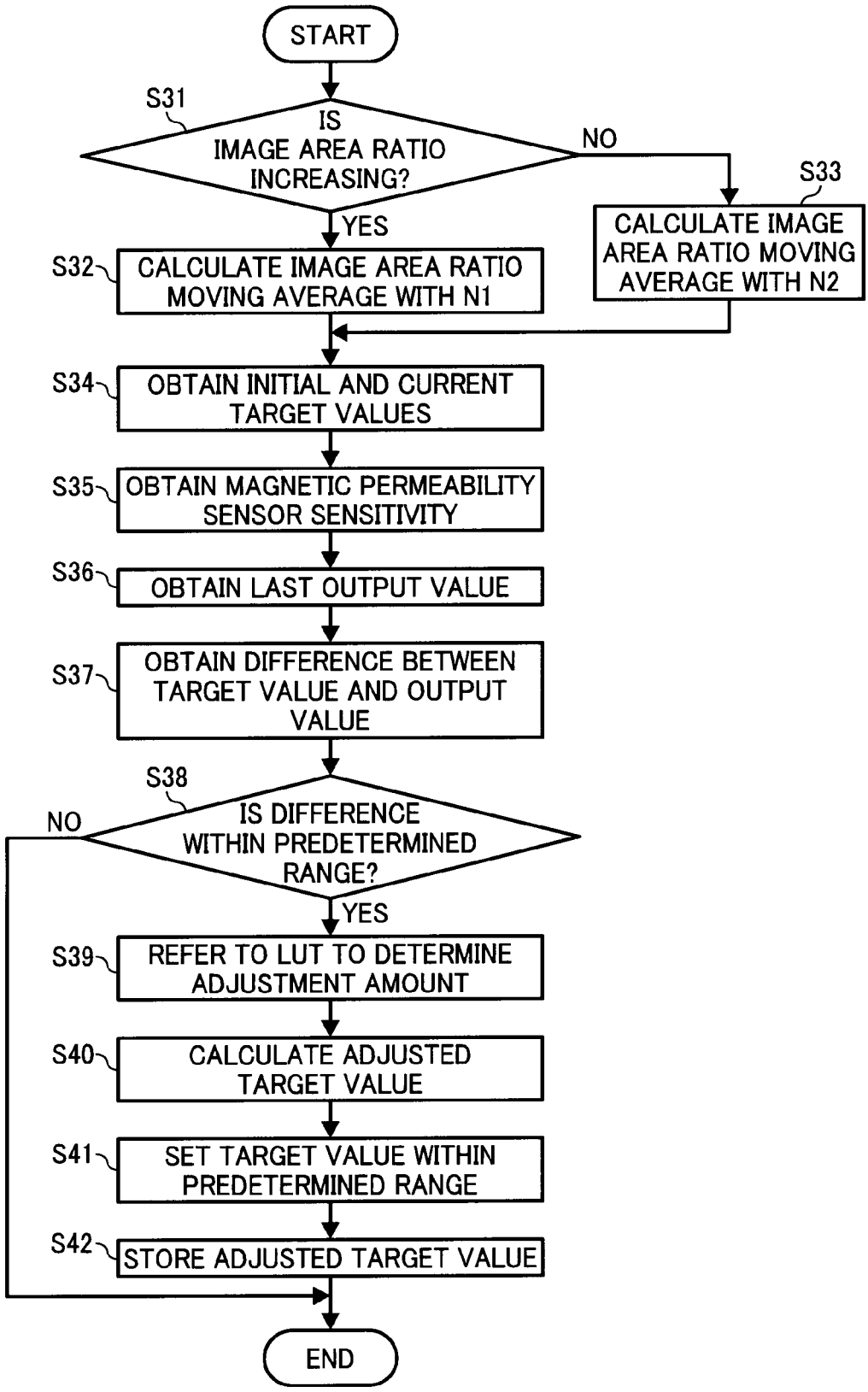
FIG. 18 illustrates a sequence of processes performed in another target output value adjustment.

FIG. 18 illustrates a sequence of processes performed in target output value adjustment according to another illustrative embodiment based on the results of experiments A through C. In the target output value adjustment, the change speed of the target output value $Vt_{ref}$ is slower when the target output value $Vt_{ref}$ is adjusted so as to increase the toner concentration than when the target output value $Vt_{ref}$ is adjusted so as to decrease the toner concentration. More specifically, the number of image area ratio samples (cumulative number of sheets N) used to calculate the image area ratio moving average is larger when the target output value $Vt_{ref}$ is adjusted so as to increase the toner concentration than when the target output value $Vt_{ref}$ is adjusted so as to decrease the toner concentration. By using a larger number of samples, the change speed is lowered when images of lower image area ratio are continuously output, in other words, when the target toner concentration is increased. By lowering the change speed, the target toner concentration can be gradually increased, and thus the rise in image density can be prevented or reduced.

In the target output value adjustment illustrated in FIG. 18, the number of image area ratio samples (cumulative number of sheets N) is set to 20 when the target output value $Vt_{ref}$ is adjusted so as to increase the toner concentration and 10 when the target output value $Vt_{ref}$ is adjusted so as to decrease the toner concentration. It is to be noted that the number of samples is determined based on characteristics of the developer, developer capacity inside the developing device, and configuration of the developing device.

Further, whether the target output value $Vt_{ref}$ is adjusted so as to increase or decrease the toner concentration in the developing device can be determined based on changes in the image area ratio. More specifically, it is determined that the image area ratio is increasing when the image area ratio of the sheet output most recently is larger than the image area ratio moving average that is calculated in a previous target output value adjustment. By contrast, it is determined that the image area ratio is decreasing when the image area ratio of the last sheet is smaller than the image area ratio moving average that is calculated in a previous target output value adjustment.

Referring to FIG. 18, the sequence of the target output value adjustment described above is described below in further details.

As illustrated in FIG. 18, the controller 100 illustrated in FIG. 3 determines whether the image area ratio of the last output sheet is increasing or decreasing at S31. More specifically, the current image area ratio X (i) is deducted from the previously calculated image area ratio moving average M(i-1). When the value obtained by the deduction is zero or a negative value, at S32 the controller 100 determines that the image area ratio is increasing and calculates the image area ratio moving average M(i) with a first value of image area ratio samples N1 that is set to 10. By contrast, when the value obtained by the deduction is greater than zero, at S33, the controller 100 determines that the image area ratio is decreasing and calculates the image area ratio moving average M(i) with a second value of image area ratio samples N2 that is set to 20.

From S34 through S42, the controller 100 performs processes similar to the processes performed from S2 through S10 in FIG. 7 so as to adjust the target output value $Vt_{ref}$.

Described below is a short running test that was performed to evaluate the target output value adjustment illustrated in FIG. 18. In the short running test, 450 sheets were continuously output at a standard liner speed of 138 mm/s and the image area ratio was varied as shown in TABLE 2 shown above.

Figure 19:
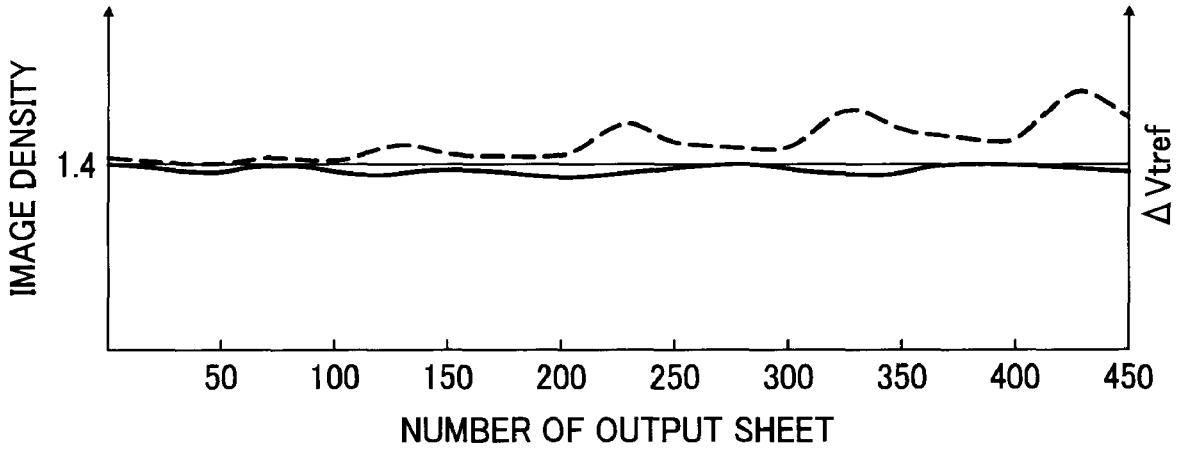
FIG. 19 is a graph illustrating results of the target output value adjustment illustrated in FIG. 18 and a comparative example.

FIG. 19 illustrates results of the short running test. In FIG. 19, a solid line shows results of the target output value adjustment illustrated in FIG. 18 in which the number of image area ratio samples N is different when the image area ratio is increasing and decreasing, and a dashed line shows results of a comparative example in which the number of image area ratio samples N is identical in both of those cases.

Referring to FIG. 19, in the results of the comparative example shown by the dashed line, image density temporarily increased when the image area ratio of output sheets decreased. Particularly, when images of a first image area ratio were continuously output and then images of a second image area ratio that was lower than the first image area ratio were continuously output, the larger the difference in the image area ratio was, the higher image density became. By contrast, in the results of the target output value adjustment illustrated in FIG. 18, image density was substantially constant around the target value of 1.4 throughout the test.

Therefore, when the current image area ratio is decreasing, the sudden increase in image density can be prevented or reduced and image density can be kept substantially constant by increasing the number of image area ratio samples from that used when the current image area ratio is increasing as in the target output value adjustment illustrated in FIG. 18.

Further, when the toner in the developing device is charged relatively easily, the toner can be charged sufficiently before a subsequent image formation even if the target toner concentration is relatively rapidly increased. However, when the toner in the developing device is not charged relatively easily, the target toner concentration should be increase at a slower speed so as to charge toner sufficiently before a subsequent image formation and maintain a constant image density. Therefore, it is preferable to change the speed of change of the target toner concentration (change speed) according to toner charge characteristics. Information that relates to toner charge characteristics (second information) includes environmental conditions in the developing device and changes in toner characteristics over time.

When toner charge characteristics are determined based on environmental conditions, the controller 100 obtains detection result of the temperature and humidity sensor 61 100 illustrated in FIG. 1. That is, the controller 100 serves as a second information detector. Under lower temperature and lower humidity conditions, for example, a temperature of 10° C. and a humidity of 15%, charge amount per unit time when toner in the developing device is agitated is larger and toner is relatively easily charged. Therefore, in this case, the change speed is increased from that used under the normal environmental conditions with a temperature of 23° C. and a humidity of 65% by decreasing the number of image area ratio samples. By contrast, under higher temperature and higher humidity conditions, for example, a temperature of 27° C. and a humidity of 80%, charge amount per unit time when the toner in the developing device is agitated is smaller and the toner is not relatively easily charged. Therefore, in this case, the change speed is decreased from that used under the normal environmental conditions by increasing the number of image area ratio samples.

Moreover, in a case in which toner charge characteristics are determined based on changes in toner characteristics over time, the change speed is decreased by increasing the number of image area ratio samples when toner charge characteristics deteriorates. It is to be noted that changes in characteristics of the toner over time is determined based on the number of output sheets. That is, a reference number of output sheets to determine that toner charge characteristics have deteriorated is preliminary determined through experiment. When the number of output sheets reaches the predetermined reference number, the controller 100 increases the number of image area ratio samples so as to decrease the change speed.

Alternatively, toner charge characteristics may be determined comprehensively by using both information related to environmental conditions in the developing device and changes in toner characteristics over time.

As described above, according to illustrative embodiments illustrated in FIGS. 12 and 18, a preferable image density can be obtained even if toner charge characteristics in the developing device change with changes in environmental conditions.

As described above, in the target output value adjustment illustrated in FIG. 18, the speed of change of the target toner concentration is slower when the target toner concentration is increased than when the target toner concentration is decreased. With this adjustment, when the target toner concentration is increased, the toner is gradually increased so that the amount of the toner in the developing device that is not sufficiently charged does not suddenly increase. By contrast, when the target toner concentration is decreased, the toner is rapidly decreased. Thus, an increase in image density can be prevented or reduced.

Further, the controller 100 that serves as the toner concentration control reference value changer changes the target output value $Vt_{ref}$ based on the image area ratio moving average of the images formed during a given time period. Therefore, the target output value $Vt_{ref}$ can be adjusted better because a history of the toner replacement amounts of sheets output most recently can be obtained, and a current characteristics of the developer can be better determined.

Moreover, when the target toner concentration is increased, the number of image area ratio samples N used to calculate its moving average (cumulative number of sheets) is set to a larger number than that used when the target toner concentration is decreased. With this adjustment, the moving average does not decrease significantly even if the current image area ratio is significantly decreased from that of the sheet previously output. As a result, a sudden increase in the toner concentration can be prevented, maintaining constant developability so as to maintain a constant image density. By contrast, because the number of image area ratio samples N is smaller when the target toner concentration is decreased, the moving average is significantly increased when the current image area ratio significantly increases from that of the sheet previously output. Therefore, the toner concentration can be more rapidly decreased to a value corresponding to that image area ratio, thus maintaining constant developability so as to maintain a constant image density.

Further, a preferable speed of change of the target toner concentration depends on toner charge characteristics in the developing device. Therefore, image density can be kept constant in both cases in which the toner concentration is increased and decreased by detecting the information to determine toner charge characteristics and setting the change speed based on the detected information.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image carrier configured to carry an electrostatic latent image;

a developing device configured to develop the electrostatic latent image with a two-component developer including toner and magnetic carrier;

a toner supplier configured to supply the toner to the developing device;

a toner concentration detector configured to detect toner concentration in the two-component developer inside the developing device; and a controller configured to detect first information to determine toner replacement amount in the developing device during a predetermined time period and second information to determine a charge characteristic of the toner in the developing device, wherein the controller changes a toner concentration control reference value based on the first information and the second information, and controls the toner concentration based on the toner concentration control reference value and an output from the toner concentration detector, wherein the controller determines an adjustment amount of the toner concentration control reference value based on the first information, and changes the adjustment amount based on the second information, and wherein the controller changes the adjustment amount of the toner concentration control reference value in a direction to increase toner concentration in the developing device when the second information indicates that the toner is more easily charged.

2. The image forming apparatus according to claim 1, wherein the second information relates to developability of the toner.

3. The image forming apparatus according to claim 1, wherein the second information relates to an environment condition inside the developing device.

4. The image forming apparatus according to claim 1, wherein the second information relates to changes in the two-component developer over time.

5. The image forming apparatus according to claim 1, wherein, when the second information indicates that the toner is more easily charged, a change amount of the adjustment amount of the toner concentration control reference value is larger in a case in which the toner replacement amount in the developing device in the predetermined time period is smaller than a value used in a case in which the toner replacement amount in the developing device in the predetermined time period is larger.

6. The image forming apparatus according to claim 1, wherein the controller changes the toner concentration control reference value after a previous image formation before a subsequent image formation.

7. An image forming apparatus, comprising:

an image carrier configured to carry an electrostatic latent image;

a developing device configured to develop the electrostatic latent image with a two-component developer including toner and magnetic carrier;

a toner supplier configured to supply the toner to the developing device;

a toner concentration detector configured to detect toner concentration in the two-component developer inside the developing device; and a controller configured to detect first information to determine toner replacement amount in the developing device during a predetermined time period and second information to determine a charge characteristic of the toner in the developing device, wherein the controller changes a toner concentration control reference value based on the first information and the second information, and controls the toner concentration based on the toner concentration control reference value and an output from the toner concentration detector, wherein the controller determines an adjustment amount of the toner concentration control reference value based on the first information, and changes the adjustment amount based on the second information, and wherein the controller changes the adjustment amount of the toner concentration control reference value in a direction to decrease toner concentration in the developing device when the second information indicates that the toner is less easily charged.

8. The image forming apparatus according to claim 7, wherein, when the second information indicates that the toner is less easily charged, a change amount of the adjustment amount of the toner concentration control reference value is larger in a case in which the toner replacement amount in the developing device in the predetermined time period is larger than a value used in a case in which the toner replacement amount in the developing device in the predetermined time period is smaller.

9. An image forming apparatus, comprising:

an image carrier configured to carry an electrostatic latent image;

a developing device configured to develop the electrostatic latent image with a two-component developer including toner and magnetic carrier;

a toner supplier configured to supply the toner to the developing device;

a toner concentration detector configured to detect toner concentration in the two-component developer in the developing device; and a controller configured to detect first information to determine toner replacement amount in the developing device during a predetermined time period, change a toner concentration control reference value based on at least the first information, and control the toner concentration based on the toner concentration control reference value and an output from the toner concentration detector, wherein the controller changes the toner concentration control reference value in a direction to increase the toner concentration at a change speed slower than a change speed to change the toner concentration control reference value in a direction to decrease the toner concentration, wherein the controller detects one of image area and image area ratio of images formed during the predetermined time period as the first information and changes the toner concentration control reference value based on a moving average of one of the image area and the image area ratio, and wherein a number of samples used to calculate one of the image area and the image area ratio is larger when the controller changes the toner concentration control reference value in a direction to increase the toner concentration than the number of samples used when the controller changes the toner concentration control reference value in a direction to decrease the toner concentration.

10. The image forming apparatus according to claim 9, wherein the controller further detects second information to determine a charge characteristic of the toner and changes the change speed based on the second information.

11. The image forming apparatus according to claim 10, wherein the controller detects information related to developability as the second information.

12. The image forming apparatus according to claim 10, wherein the controller detects information to determine an environmental condition inside the developing device as the second information.

13. The image forming apparatus according to claim 10, wherein the controller detects information to determine changes in the two-component detector over time as the second information.

14. An image density control method used in an image forming apparatus comprising:

an image carrier configured to carry an electrostatic latent image;

a developing device configured to develop the electrostatic latent image with a two-component developer including toner and magnetic carrier;

a toner supplier configured to supply the toner to the developing device;

a toner concentration detector configured to detect toner concentration in the two-component developer inside the developing device; and a controller, the image density control method comprising:

detecting first information to determine toner replacement amount in the developing device during a predetermined time period and second information to determine a charge characteristic of the toner in the developing device;

changing a toner concentration control reference value based on the first information and the second information; and controlling the toner concentration based on an output from the toner concentration detector and the toner concentration control reference value, and wherein the controller determines an adjustment amount of the toner concentration control reference value based on the first information, and changes the adjustment amount based on the second information, and wherein the controller changes the adjustment amount of the toner concentration control reference value in a direction to increase toner concentration in the developing device when the second information indicates that the toner is more easily charged.

15. The image density control method according to claim 14, further comprising:

changing a speed to change the toner concentration control reference value depending on whether the toner concentration control reference value is changed in a direction to increase the toner concentration or the toner concentration control reference value is changed in a direction to decrease the toner concentration.

* * * * *